US007121207B2

(12) United States Patent
Tabor et al.

(10) Patent No.: US 7,121,207 B2
(45) Date of Patent: Oct. 17, 2006

(54) SYSTEMS AND METHODS FOR NEWSPAPER PRESS CUT-OFF REDUCTION

(75) Inventors: Gregory F. Tabor, Downer's Grove, IL (US); Michael Hart, Channahon, IL (US); Carlos F. Noa, Plainfield, IL (US)

(73) Assignee: Pressline Services, Inc., St. Louis, MO (US)

( * ) Notice: Subject to any disclaimer, the term of this patent is extended or adjusted under 35 U.S.C. 154(b) by 195 days.

(21) Appl. No.: 11/011,858

(22) Filed: Dec. 14, 2004

(65) Prior Publication Data

US 2005/0126413 A1 Jun. 16, 2005

Related U.S. Application Data

(63) Continuation-in-part of application No. 10/458,790, filed on Jun. 10, 2003, now Pat. No. 6,829,985.

(60) Provisional application No. 60/387,538, filed on Jun. 10, 2002.

(51) Int. Cl.
*B41F 3/48* (2006.01)

(52) U.S. Cl. ..... 101/480; 101/479; 101/483 B

(58) Field of Classification Search ..... None
See application file for complete search history.

(56) References Cited

U.S. PATENT DOCUMENTS 4,620,480 A 11/1986 Hermach
4,677,911 A 7/1987 Hermach
4,875,936 A * 10/1989 Hermach ..... 101/218
4,932,321 A * 6/1990 Hermach ..... 101/211
5,005,475 A * 4/1991 Knauer ..... 101/218
5,481,972 A * 1/1996 Schmid ..... 101/216
5,868,071 A * 2/1999 Niemiro et al. ..... 101/218
7,032,515 B1 * 4/2006 Zimich et al. ..... 101/480

OTHER PUBLICATIONS

280-MM Maintenance Manual, Goss Metroliner II Printing Units with Injector Ink System, Rockwell International, Graphic Systems Division, Oct. 1981, Revised Feb. 1988.

* cited by examiner

*Primary Examiner*—Daniel J. Colilla
(74) *Attorney, Agent, or Firm*—Lewis, Rice & Fingersh, L.C.

(57) ABSTRACT

Systems and methods for modifying, altering, constructing, or retrofitting an existing newspaper press having a first cut-off length, to have a second cut-off length which is different from and generally less than the first. These systems and methods generally provide for the machining of new bore holes into the existing press unit frame. The new bore holes will generally completely encompass the old bore holes and allow for linear translation of the axes of rotation of the new cylinders relative to the positions of the axes for the old cylinders.

19 Claims, 32 Drawing Sheets

SYSTEMS AND METHODS FOR NEWSPAPER PRESS CUT-OFF REDUCTION

CROSS REFERENCE TO RELATED APPLICATIONS

This application is a Continuation-in-part of and claims priority to U.S. Utility patent application Ser. No., 10/458,790, filed Jun. 10, 2003 now U.S. Pat. No. 6,829,985 which is turn claims priority to U.S. Provisional Application Ser. No. 60/387,538 filed Jun. 10, 2002. The entire disclosure of both documents is herein incorporated by reference.

BACKGROUND OF THE INVENTION

1. Field of the Invention

This disclosure relates to the field of newspaper presses. In particular, to the reboring of plate and blanket cylinder bores of existing newspaper presses to allow for the use of differently sized plate and blanket cylinders in the press.

2. Description of the Related Art

One natural resource which has gained a lot of attention recently is paper. In the last few years, paper recycling to reuse discarded paper has become a much more common activity and has become, for many, a big business. Further, as increased political pressure is brought to bear on paper use and paper recycling, paper has generally increased in price to accommodate increased recycling as well as to encourage more efficient use of new and recycled paper.

For a newspaper, the cost of the raw newsprint upon which to print the newspaper can be the most important consideration in whether the newspaper can survive in the marketplace and can be the most significant cost in operating the newspaper. In today's world, a newspaper must compete against radio, television, and the Internet for its share of advertiser's dollars spent towards reporting. As these other technologies are not bound by the use of paper, the cost of raw newsprint can determine whether or not a newspaper can compete and ultimately survive. Newsprint pricing regularly fluctuates on a quarterly basis which can often leave the newspaper uneasy about how the bottom line will look at the end of the year as even a small fluctuation can cancel out the profit margin built into the paper at the beginning of the year.

Most newspaper press lines running today were installed in the 1970's and 1980's before newsprint prices were inflated to the point they are today, when newsprint prices were more stable, and before the need to conserve paper was fully understood. When these presses were installed, the printed size of a page of a newspaper and therefore the size and design of the newspaper presses was generally selected to obtain a particular look of the newspaper or to allow a particular number of articles of a particular size to appear on various pages, instead of to preserve newsprint. For this reason, many of these presses utilize newspaper pages which are larger than their more modern counterparts. In the newspaper business, this difference in the newspaper size can result in a massive difference in profitability in the market.

In a newspaper, there are effectively two dimensions of the paper which can be controlled and which determine the amount of paper which is required to print each newspaper. A single sheet of newspaper (the pages which connect in the middle and are printed on both sides (four pages)) is generally a quadrilateral shape. A newspaper printing press will generally print newspaper pages on a roll of paper (or a paper web as it is often called). This web is printed with multiple sheets across the width of the paper roll (two or more sheets or eight or more pages) with these same pages repeated down the roll of paper. Alternatively, the press may print a first row of sheets, and then a second (or even third) row below that, before repeating the same pattern of rows. In this way, the newspaper sheets are essentially printed repetitively (serially) on the roll as it is unwound.

This design results because the press generally utilizes a continuously revolving cylinder as the printing surface to print the page. The cylinder has a length corresponding to the width of the paper roll and generally prints two or four sheets with each revolution (or half revolution) down the length of the roll. Different sheets are printed on a different paper roll (generally on a different press unit) with the newspaper comprising the appropriate sheets from a plurality of press units being properly arranged, cut and folded together.

As the pages are generally printed upright, to utilize a smaller horizontal dimension, a narrower paper roll is used and the press is set up to not utilize the entire length of the printing surface but only that which corresponds to the width of the roll (the ends of the printing cylinder are contacting only empty space as there is no paper to contact), Alternatively, a wider paper roll could be used utilizing more of the length of the printing cylinder and the system could be set up to print more sheets along the width of the paper. For example, two and a half narrower sheets (10 pages) or even three narrower sheets (12 pages) may be printed along the width of a slightly wider roll of paper.

Because of the way the newspaper press is designed, while this horizontal dimension modification is fairly easy, it is difficult to change the height dimension of a newspaper or what is generally called the "cut-off" or "cut-off length." The printing cylinder has a fixed circumference and because the cylinder endlessly rotates providing the repeated pattern of pages, the circumference of the cylinder corresponds to a predetermined number of complete pages. If the page length is shortened without changing the circumference of the cylinder, while the resultant newspaper size may be decreased, the cylinder still "prints" the section which had previously been used, it is just blank and is either still included in the resultant newspaper as simply a wide margin, or is somehow discarded as waste. Such a system does not save any paper.

In some dynamic presses, the printing cylinder could be modified dynamically so that a continuously changing pattern of repeating pages could be printed to allow for a printing cylinder to print a non-whole number of pages with each revolution, but such a dynamic system would be very expensive and difficult to operate making it unusable for most newspaper printing operations.

In order to alter the cut-off length of the paper in a conventional press line, either the pages must be made an equal subdivision of the existing page size (e.g. a print cylinder which has a circumference of one sheet can be made to print two sheets of half the original height) or the circumference of the printing cylinder must be changed. While the first of these concepts reduces the page size, it does not necessarily reduce the paper use as the newspaper will simply print twice as many half size pages. Further, a newspaper of half size often requires a completely different layout to be accepted by readers resulting in different problems. Therefore, the best solution is to have the press print the paper using a printing cylinder of a smaller diameter (and therefore a smaller circumference resulting in a decreased cut-off length).

While decreasing the printing cylinder diameter sounds like a relatively simple operation, with an existing press, the printing cylinders and other components of the press are arranged to interact with each other by contact at their circumferential surfaces. If the printing cylinders diameters are simply decreased, necessary interactions will not occur and ink will not be correctly transferred to the paper web. Instead, cylinders of a decreased diameter generally require a closer, more compact arrangement where the axes of the cylinders are placed closer to each other.

Existing press units are large, heavy, and expensive pieces of machinery. The press unit principally comprises a large frame formed out of a material such as cast iron or steel with holes bored therethrough to enable the attachment of the various moveable components in a precise relation. Because of this design, switching to a smaller print roller currently requires completely replacing most, if not all, of the existing press line as the press units generally cannot be modified to have mounts suitable for the new printing cylinders. While this is a viable solution in some cases, most of the time it is cost prohibitive as presses on a single press line (generally 6 or more printing units, a folder and related structures) would all need to be replaced simultaneously, which is a massive capital expense.

Many newspaper press lines in use today that were installed prior to the interest in paper reduction utilize a newspaper page height of 21 ½", 22", 22 ¾", or 23 9/16". Today, new newspaper press lines are installing new presses that print at a 21" length to save paper. These presses can save 8% to 10% of the newsprint over what an older press uses which is a gigantic savings in cost and materials. There is therefore a need in the art to have systems and methods for allowing an older press unit utilizing a first cut-off length, to be modified so as to have a new shorter cut-off length.

SUMMARY

For these and other reasons known to those of ordinary skill in the art, described herein are systems and methods for modifying, altering, constructing, or retrofitting, an existing newspaper press having an existing cut-off length, to have a new cut-off length which is different from and generally less than the existing cut-off length. These systems generally provide for the machining of new larger bore holes into the existing press unit frame. The new bore holes completely encompass the old bore holes and allow for linear translation of the axes of rotation of the new cylinders relative to the positions of the axes for the old cylinders.

In an embodiment there is described herein, a method for converting a newspaper press unit to produce a different cut-off length, the method comprising: providing a press unit located as part of a press line, said press unit having a press unit frame supporting existing blanket cylinders and existing plate cylinders in existing blanket bore holes and existing plate bore holes respectively; removing said existing blanket cylinders and said existing plate cylinders from said existing blanket bore holes and said existing plate bore holes; aligning a drill fixture to said frame, said drill fixture including an alignment pin arranged in proximity to at least one of a side and the top of said press unit; attaching said drill fixture to said frame; boring, based on said drill fixture, a plurality of support holes removing said drill fixture; aligning a plate and blanket fixture, said plate and blanket fixture including an alignment pin arranged in proximity to at least one of said side and said top of said press unit to which said alignment pin of said drill fixture was placed in proximity to; attaching said plate and blanket fixture to said frame via said support holes; boring, based on said plate and blanket fixture, new blanket bore holes and new plate bore holes, said new blanket bore holes and said new plate bore holes having a diameter greater than said existing blanket bore holes and said existing plate bore holes respectively and encompassing said existing blanket bore holes and said existing plate bore holes respectively; removing said plate and blanket fixture; placing new plate cylinders and new blanket cylinders having a new diameter in said new plate bore holes and said new blanket bore holes respectively; and using said new plate cylinders and said new blanket cylinders to print a newspaper having a different cut-off length.

In an embodiment of the method at least one of said new blanket cylinders is mounted by placing journals of said blanket cylinder in a mounting hole in a sleeve, and placing said sleeve in said new blanket bore hole.

In an embodiment of the method, the cut-off length is changed to 21 inches or less from a cut-off length of 21 and ½ inches, 22 inches, 22 and ¾ inches, 23 and 9/16 inches, or other value.

In another embodiment of the method said plate and blanket fixture is one of a set of two plate and blanket fixtures, one of said set of two plate and blanket aligning fixtures attaching to an operator side of said press unit and the other of said set of two plate and blanket aligning fixtures attaching to the drive side of said press unit.

In another embodiment of the method said drill fixture includes at least three alignment pins. At least two of said alignment pins on said drill fixture may arranged in proximity to said top of said press unit, and at least one of said alignment pins on said drill fixture is arranged in proximity to said side of said press unit. The plate and blanket fixture may also include at least three alignment pins. At least two of said alignment pins on said plate and blanket fixture may be arranged in proximity to said top of said press unit, and at least one of said alignment pins on said plate and blanket fixture is arranged in proximity to said side of said press unit.

In another embodiment there is described, a method for machining new bore holes for mounting blanket and plate cylinders in a printing press, the method comprising: providing a newspaper press located as part of a press line; removing from said press old blanket cylinders and old plate cylinders from old blanket bore holes and old plate bore holes respectively; attaching a first fixture, said first fixture being aligned with a side and a top of said press unit; boring, based on said first fixture, a plurality of support holes; removing said first fixture; attaching a second fixture, aligned with said side and said top of said press unit to which said first fixture was aligned to said press unit using said support holes; boring, based on said second fixture, new bore holes; removing said second fixture; and placing new plate cylinders and new blanket cylinders having a new diameter in said new bore holes.

In another embodiment of the method, there is also included the step of placing components which form part of the ink train of said press, when used with said new plate cylinder and said new blanket cylinders, in at least some of said support holes.

In a still further embodiment there is described, a set of fixtures for use in machining new bore holes for mounting blanket and plate cylinders in a printing press unit, the set of fixtures comprising: a drill fixture, said drill fixture including: a frame comprised of a rigid material; at least three alignment pins arranged on said fixture in a manner such that they can be placed adjacent to a top and a side of said printing press unit; and a plurality of support alignment guides machined through said frame; wherein, when said three alignment pins are arranged adjacent said top and said side of said printing press unit, said support alignment guides indicates a position to machine new support holes in said printing press unit; and a plate and blanket fixture, said plate and blanket fixture including: a frame comprised of a rigid material; at least three alignment pins arranged on said fixture in a manner such that they can be placed adjacent to a top and a side of said printing press unit; a plurality of support mountings machined through said frame; and two blanket hole guides and two plate hole guides machined through said frame; wherein, when said at least three alignment pins are arranged adjacent said top and said side of said printing press unit, said support mountings align with said new support holes in said printing press unit; and wherein said blanket hole guides and said plate hole guides can be used to bore new blanket holes and new plate holes respectively in said press unit.

In another embodiment of the set of fixtures, the set of fixtures comprises a single drill fixture and two plate and blanket fixtures and the drill fixture may include an additional three alignment pins arranged to extend from said frame in a direction opposite said three alignment pins.

In yet another embodiment there is described a method for converting a newspaper press half deck to produce a different cut-off length, the method comprising: providing a three-color unit comprising a half deck located on a standard unit and having a half deck frame supporting an existing blanket cylinder, an existing plate cylinder, and an existing common impression cylinder in an existing blanket bore hole, an existing plate bore hole, and an existing common impression cylinder bore hole respectively; removing said existing blanket cylinder, said plate cylinder, and said common impression cylinder from said existing blanket bore hole, and said existing plate bore hole and said existing general impression bore hole; aligning a drill fixture to said frame, said drill fixture including an alignment pin arranged in proximity to the top of said standard press unit and within said existing common impression cylinder bore hole; attaching said drill fixture to said frame; boring, based on said drill fixture, a plurality of support holes; removing said drill fixture; attaching a plate cylinder boring fixture to said frame via said support holes; boring, based on said plate cylinder boring fixture, a new plate bore hole, said new plate bore hole having a diameter greater than said existing plate bore hole and encompassing said existing plate bore hole; removing said plate cylinder boring fixture; placing new plate cylinders and new blanket cylinders having a new diameter in said new plate bore holes and said existing blanket bore holes respectively; and using said new plate cylinders and said new blanket cylinders to print a newspaper having a different cut-off length.

BRIEF DESCRIPTION OF THE FIGURES

FIG. 15 provides various views of the drill fixture of FIG. 10 in place on the drive side of a press unit frame. FIG. 15A shows a front view while

FIG. 16 provides various views of the plate and blanket bore aligning fixtures of FIG. 11 and in place on the press unit frame. FIG. 16A shows a front view of the operator's side arrangement while

FIG. 17 provides various views of a drill fixture for use on a half-deck. FIG. 17A shows a top view while

FIG. 18 provides various views of a plate cylinder boring fixture for use on a half deck. FIG. 18A is a front view while

FIG. 19 provides various views of the drill fixtures of FIG. 17 in place on a press unit frame of a half-deck. FIG. 19A provides a front view of the drive side while

FIG. 20 provides various views of the plate and blanket bore aligning fixtures of FIG. 18 in place on the press unit frame of a half deck. FIG. 20A provides a front view of the operator side while

DESCRIPTION OF PREFERRED EMBODIMENT(S)

Figure 1:
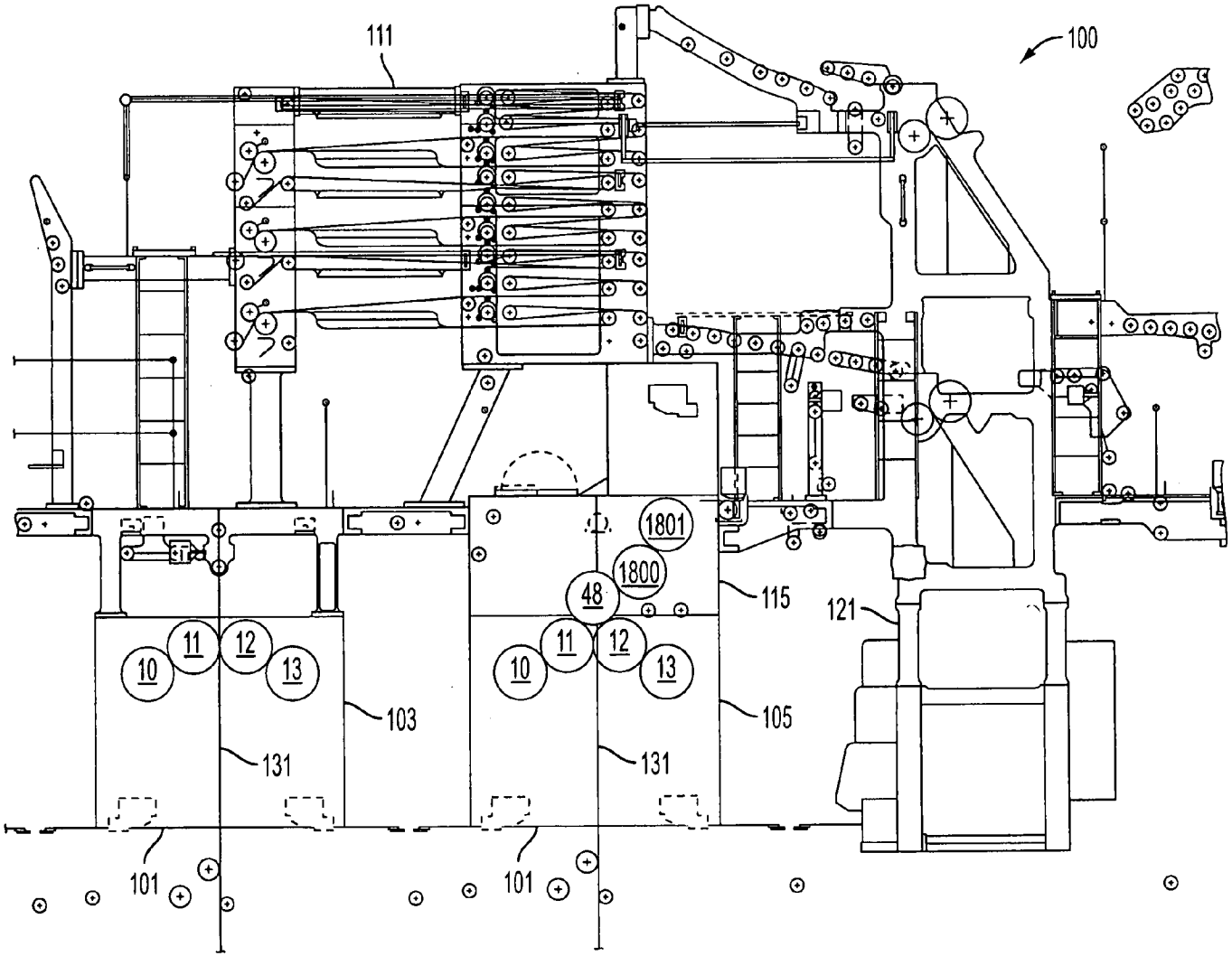
FIG. 1 PRIOR ART
FIG. 1 provides a drawing of a portion of a press line of the prior art showing two printing units (a standard unit and a three color unit (standard unit with a half-deck)) as well as a folder and some of the angle bars for interacting with the paper web.

While the embodiments described below discuss the systems and methods used in the modification of existing printing presses having an existing cut-off of 21 ½", 22", 22 ¾", or 23 9/16" being adapted to have a cut off of 21" or less, one of ordinary skill in the art would understand that these systems and methods could be used which are designed to reduce the cut-off length of any original cut-off length press unit to any other value. Further, the systems and methods could also be used to increase the cut-off length if such an increase was desired.

The discussion below will also discuss modifications made to the frame of a press unit. This discussion presumes that the frame of the unit is accessible and that any coverings or casings from the press unit have previously been removed in a manner known to one of ordinary skill in the art and that the press being modified is suitably accessible to perform these modifications on. For this reason, all drawings herein generally show the frame of a press unit utilizing general iconographic representation as opposed to any one particular look. The press unit modified in the discussion herein utilizes offset lithography as the printing technique. This is by no means required and the technique could be used on a press utilizing any type of printing technique. Bore hole placement and the exact positioning of relationships in the figures are intended to be demonstrative, and are not necessarily to scale.

The systems and methods will be discussed in terms of their application principally to a standard press unit and will occasionally be expanded to a half deck for integration on the standard press unit to apply the systems and methods to a three color unit. One of ordinary skill in the art would understand that the techniques could also be applied to other standard units, half deck units, full deck units, three color units, four color units, and/or tower units utilizing the same principles and without undue experimentation. The systems and methods here may in fact be used to provide for the necessary linear translation of axes of rotation in any press system utilizing printing cylinders.

One of ordinary skill in the art would also understand that the discussion herein is focused on how to modify an existing press unit so that the press unit operates with plate and blanket cylinders of smaller diameters. With this alteration making the resulting newspaper smaller, it is also likely that other components of the press line would have to be altered to accommodate this change. Ink form rollers, idler gears and other components may need to be changed to correctly calibrate the press line to accommodate the smaller page size. Further, the folder would also need to be modified to cut the pages at the correct length. While these modifications would all be considered part of the modification of the press line so as to enable the creation of newspapers with the decreased cut-off length and part of this invention, a detailed discussion of these modifications is beyond the scope of this disclosure which will focus on systems and methods related to the press unit itself so as to enable the press unit to be able to mount smaller diameter printing cylinders in a fashion such that a web of paper is correctly printed by the press unit.

To begin the discussion, it is best to first look at the design of a press line in a standard newspaper press floor. FIG. 1 shows a general layout of a portion of an exemplary press line (100) as might be used in any major newspaper to print pages which are primarily black and white with so-called "spot" color or occasional full color pages. The press line (100) includes at least one press unit (101), a series of angle bars (111) and a folder (121). While the press line of FIG. 1 shows two press units (101), one set of angle bars (111) and a single folder (121); most press lines will have a folder (121) and two sets of angle bars (111) with between 4 press units (101) to 10 press units (101) depending on the desired capacity and design of the press line (100). Further, a single press room may have one or more than one press line, again depending on capacity and design, which may operate independently, or may operate in conjunction with each other. For the purpose of this disclosure, it will be presumed that the press line include at least one press unit (101) and any other associated structure necessary which operates in the standard manner known to those of ordinary skill in the art.

The press units (101) may be any type of press unit (101) but will generally be either standard units (103), three color units (105) (which is usually a standard unit (103) with a half deck unit (115) placed thereon), four color units (which is usually a standard unit (103) with a full deck unit (not shown) placed thereon) or tower units (not shown). The half deck (115) shown would be considered a "13 side" half deck based on its arrangement, a "10 side" half deck would be considered essentially interchangeable and would be arranged in a mirrored position. The type of press unit (101) depends upon the flexibility originally built into the press line (100). A pure black and white press line (100), for instance, will generally only have standard units (103), while a press line (100) utilizing some color (spot or process color) may have some three color units (105), four color units and/or towers. Full color press lines or press lines designed to be highly versatile, may comprise all tower press units.

Regardless of the exact press units (101) used, the press line will generally operate in a similar fashion. Paper (131) will be fed from a paper roll to the press units (101) generally from underneath the press units (101). The paper (131) will be of a predetermined width and will generally be provided on a large diameter roll containing a length many times greater than the height of any particular newspaper page. The page will generally be printed upright so that if the roll of paper is viewed before cutting, there will be a predetermined number of pages arranged side to side across the width of the roll, with the same pages repeated serially down the roll as it unwinds and is printed. The exact width of the paper roll is selected based on the width of the press unit (101) and the desired size of the resultant pages.

As the paper (131) comes up through the press unit (101), ink and dampener solution are transferred from various troughs or other storage devices onto a series of transfer rollers. Eventually the ink and dampener solution are applied to a plate cylinder (10) or (13). While the term "cylinder" is used for some components while "roller" or "drum" is used for others, this is done for convenience and does not imply any structure to any component which could not be encompassed through the use of a different term. Plate cylinder (10) or (13) includes the necessary structure to allow for the ink to be placed into the correct format so as to form the necessary text or images to be printed. This may be the actual shape to be printed (as would be the case in offset lithography) or may be a reverse image. The plate cylinder (10) or (13) then transfers the ink to blanket cylinder (11) or (12) (forming a reverse image in offset lithography) which then transfers the ink to the paper (131) printing the page. Both sides of the page are generally printed simultaneously by the two blanket cylinders (11) and (12) in a standard press unit (103). If a three color press unit (105) is used, the paper (131) may be routed past an additional plate cylinder (1801) and blanket cylinder (1800).

It is important to note that the reference numbers chosen for the plate (10), (13), and (1801) and blanket (11), (12), and (1800) cylinders in this disclosure were specifically chosen. Various references related to these cylinders utilizing these same reference numbers are known in the industry. Therefore, the choice of reference and depicted side implies which side of the press unit (101) is being viewed (and that the half deck discussed is a "13 side" half deck as opposed to a "10 side" half deck, although the description herein could be readily adapted to a "10 side" half deck). While the systems and methods can obviously be reversed if the system is being accessed from a different side, this use of reference numbers does help to provide for a particular indication of particular structure as generally no other distinguishing characteristics of the press unit (101) are used. In the case of FIG. 1 the choice of reference numbers shows that the view is from the operator side of the press.

Generally, the printing is accomplished by ink being transferred from the blanket cylinder (11), (12), or (1800) to the paper (131). In order to print cleanly, the paper (131) cannot be suspended over the blanket cylinder (11), (12) or (1800), but the blanket cylinder (11), (12), or (1800) must be allowed to push against a surface (generally another revolving cylinder) to transfer the ink to the paper (131) and cleanly print the page. In the standard press unit (103), the two blanket cylinders (11) and (12) push against each other printing both sides of the page simultaneously with each cylinder creating the surface for the other cylinder to push against. In the three color unit (105), there is included a common impression cylinder (48) which may be pressed against by any or all of the blanket cylinders (11), (12), or (1800) to provide the necessary surface.

Once the paper (131) has been printed by any particular press unit (101), it may be routed through additional press units (101) (or may go back through the same press unit (101)) to add additional color or colors by contacting another blanket cylinder (11), (12), or (1800) and will eventually be routed through the angle bars (111). These angle bars (111) provide for various changes in direction, orientation and/or delay in the various rolls of paper (131). As each roll of paper (131) is printed to become a collection of pages repeated serially, in order to form a newspaper having many different pages, the pages being printed by a first press unit (101) are different from the pages being printed by a second press unit (101). The angle bars (111) may also include cutting instruments to separate the sheets and/or pages printed side by side, effectively narrowing the width of the paper web where necessary. The primary purpose of the angle bars (111) is to arrange the various individual paper webs with each other so as to align the components of the resultant newspaper correctly. Generally, when the paper (131) leaves the angle bars (111) the various rolls have been arranged with their major surfaces over each other, and with different pages arranged over top of each other so that numerical ordered pages are logically arranged. Further, the repetitions of one paper roll (131) are aligned with the repetitions of the other paper rolls (131).

The paper rolls (131) are then fed into the folder (121) which cuts the individual newspapers apart. In particular, the folder (121) separates the individual newspaper sheets from the web of sheets all arranged on the series of rolls (131). Once cut, the folder (121) may arrange the pages as additionally necessary, and fold the resultant newspaper into the form found on the newsstand.

As has previously been discussed, this disclosure will focus on how to adapt the press units (101) to accommodate the use of smaller plate (10), (13), and (1801) and blanket (11), (12), and (1800) cylinders so as to print the paper rolls (131) with pages of a decreased height. From the above discussion, it should be clear that there are various important interrelationships which have to exist within the press unit (101) to allow the press unit (101) to actually print the page. These relationships are best illustrated by indications of the placement of various of the cylinders relative to each other. The relationships of a standard press unit (103) and a three color press unit (105) are shown in FIGS. 3 and 4 respectively.

Figure 3:
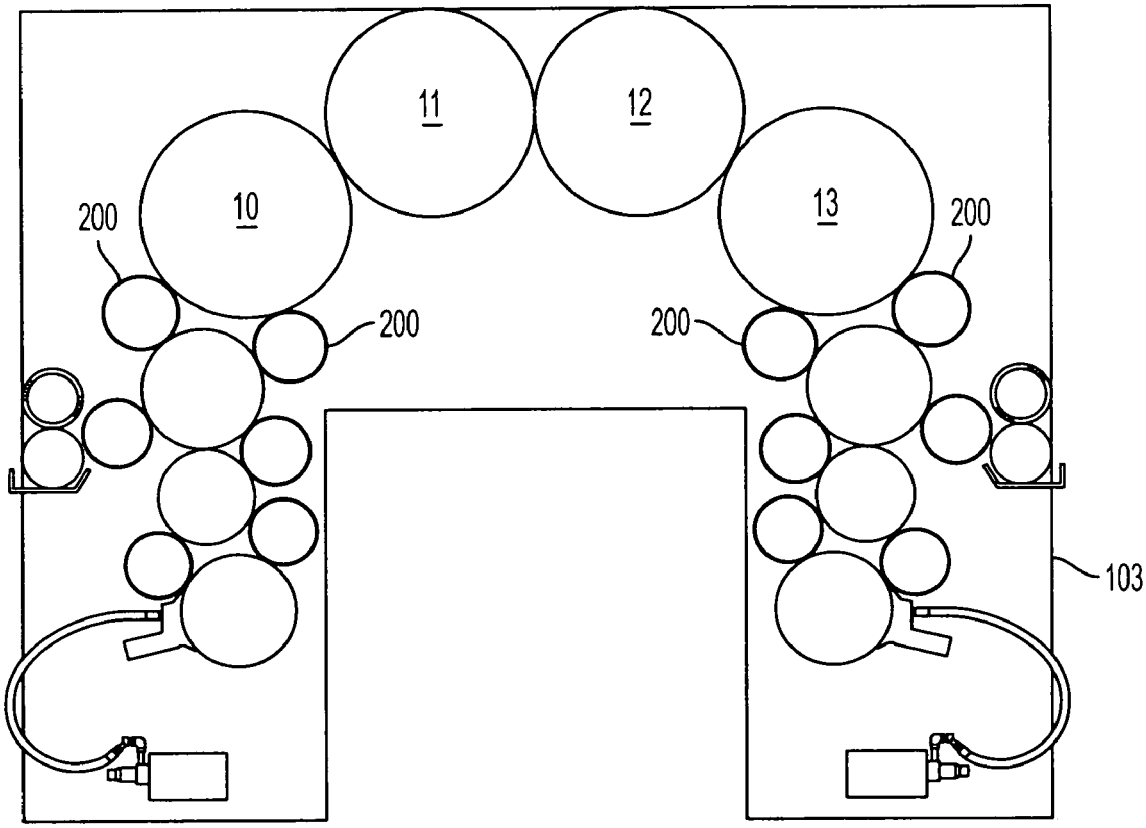
FIG. 3 PRIOR ART
FIG. 3 provides a drawing of the side of a standard press unit of the prior art showing the interactions between the various cylinders.
Figure 4:
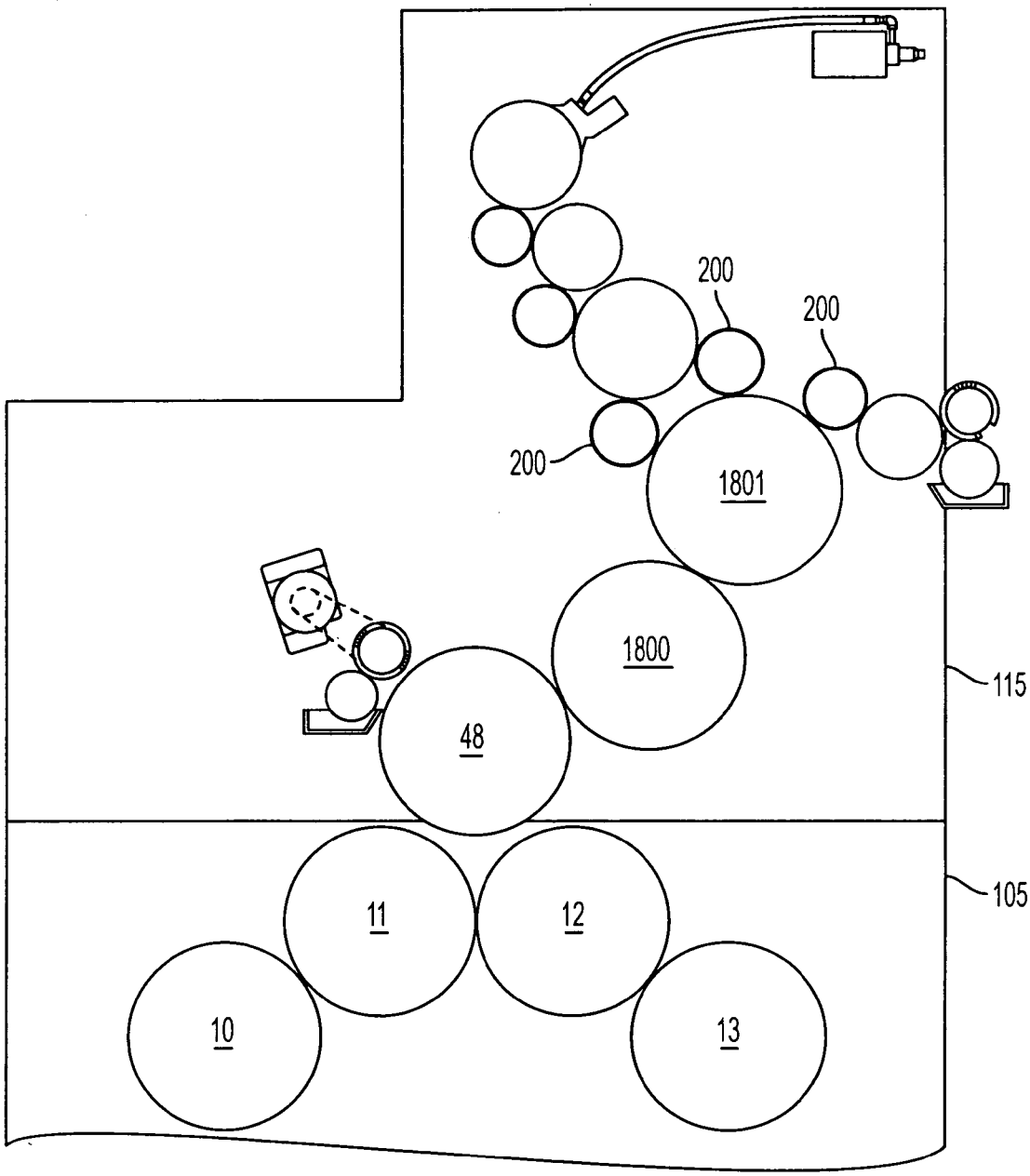
FIG. 4 PRIOR ART
FIG. 4 provides a drawing of the side of a half deck press unit mounted on a standard unit (forming a three color unit) of the prior art showing the interactions between the various cylinders.

As is clear from FIG. 3 the two blanket cylinders (11) and (12) in a standard press unit (103) must be able to have their circumferential sides touch each other (or be able to both simultaneously touch opposing sides of the paper (131), more accurately) during printing. Otherwise, ink could not be transferred from the blanket cylinders (11) and (12) to the paper (131). In the three color unit (105) of FIG. 4, the blanket cylinders (11), (12), and (1800) preferably must each be able to have their circumferential sides touch each other, and/or preferably also need to be able to alternatively and additionally be able to touch the circumferential side of the common impression cylinder (48) which is a cylinder designed to allow a blanket cylinder (11), (12), or (1800) to print one side of the paper (131) without having to print the other side of the paper (131) at the same time.

Each of the circumferential sides of the blanket cylinders (11), (12), and (1800) in turn touches the circumferential side of a corresponding plate cylinder (10), (13), and (1801) to allow for correct transfer of ink from the plate cylinder (10), (13), or (1801) to the blanket cylinder (11), (12), or (1800) so that the ink can be transferred to the page. Further, the circumferential side of each plate cylinder (10), (13), and (1801) in turn touches the circumferential side of various inking and dampening rollers (200) which are in touch with other transfer rollers to transport the ink and dampener solution to the plate cylinder (10), (13) or (1801) from appropriate storage of either.

The various arrangements of cylinders exist so that ink and dampener solution are transferred to the plate cylinders (10), (13), and (1801) and blanket cylinders (11), (12), and (1800) to be transferred to the paper (131) in the correct manner. In the standard unit (103), the organization of printing (the two blanket cylinders (11) and (12) simultaneously printing both sides of the paper (131)) is generally fairly fixed, while in the three color unit (105), multiple different paper paths can be used depending on the type of printing to be performed. Therefore, more flexibility is needed as which blanket cylinder(s) contact which other parts is variable. For this reason, the common impression cylinder (48) is included. As should be clear from this discussion, the press unit (101) is not really dependent on the exact positioning of the printing cylinders relative to any fixed location of the press unit frame in which all the units are mounted, but is instead dependent on a relationship between the various cylinders and some other locations on the frame such as ink supplies.

In particular, each blanket cylinder (11), (12) or (1800) must be able to contact another blanket cylinder (11), (12) or (1800) and/or the common impression cylinder (48) to print the page. Further, each plate cylinder (10), (13) or (1801) must be in contact with a blanket cylinder (11), (12) or (1800), and each plate cylinder (10), (13) or (1801) must be in contact with ink and dampener rollers (200) (and the roller train) to obtain those substances. As previously discussed, to decrease the cut-off length, the diameter of the actual printing cylinders is preferably decreased. Therefore, the blanket cylinders (11), (12) and (1800) have a decreased diameter. Further, because of the relationship of the blanket cylinders (11), (12) and (1800) to the plate cylinders (10), (13) and (1801), the plate cylinders (10), (13) and (1801) must also have an equal decrease in size. In adapting the press unit (101) to operate with these new cylinders, other components (such as ink drums, dampener rollers, and the common impression cylinder (48)) may be essentially freely altered as they do not directly effect the resultant cut-off length. For this reason, appropriately arranging the new plate (10), (13) and (1801) and blanket cylinders (11), (12) and (1800) relative to each other (and to a lesser extent to the common impression cylinder (48)) is the critical operation to retrofitting an existing press to have a decreased cut-off length. The remainder of this discussion focuses on how to adapt the mounting positions of these cylinders so that the press can accommodate and use them. For simplicity, the remaining discussion no longer utilizes the reference numbers for blanket cylinders (11), (12) or (1800) or plate cylinders (10), (13) or (1801) as the discussion can apply equally well to any or all of them, and in some embodiments they would be considered interchangeable.

To understand how the blanket, press and common impression cylinder operate in practice (as these are the principle cylinders, the ink drums and dampener rollers simply need to be of a sufficient design to transfer ink and dampener solution to these cylinders), it is logical to first understand how these cylinders are attached in the press unit (101) and how they serve to print the page.

First, as is apparent from the above discussion, the plate and blanket cylinders are generally rounded and print a planar surface which is the newspaper page. The printing occurs by having what will be the page pushed against the circumferential side of the blanket cylinders. The paper is then pulled through the cylinders as the cylinders rotate, transferring the image. Once the cylinder has completed one complete rotation, the image on the cylinder is printed again immediately following the prior page. In this way the repeated serial pattern of pages is obtained.

In order to decrease the cut-off length, therefore, the diameter of the blanket and plate cylinders needs to be decreased, while at the same time, the various blanket and plate cylinders, as well as the common impression cylinder and ink and dampener transfer rollers need to still be touching as discussed in conjunction with FIGS. 3 and 4 to allow for correct ink transfer and accurate printing.

In order to maintain the relationships, while still simultaneously decreasing the diameter of the plate and blanket cylinders (to decrease the cut-off length), the rotational axes of the new cylinders will need to be linearly translated from the rotational axes of the existing cylinders. If smaller circles are placed on FIG. 3 or 4 on the same axes, the cylinders would clearly not touch, which would result in a failure to correctly print. The systems and methods herein relate to how to accurately translate these axial positions, and how to modify the press unit (101) so as to use and support the new cylinders.

Figure 2:
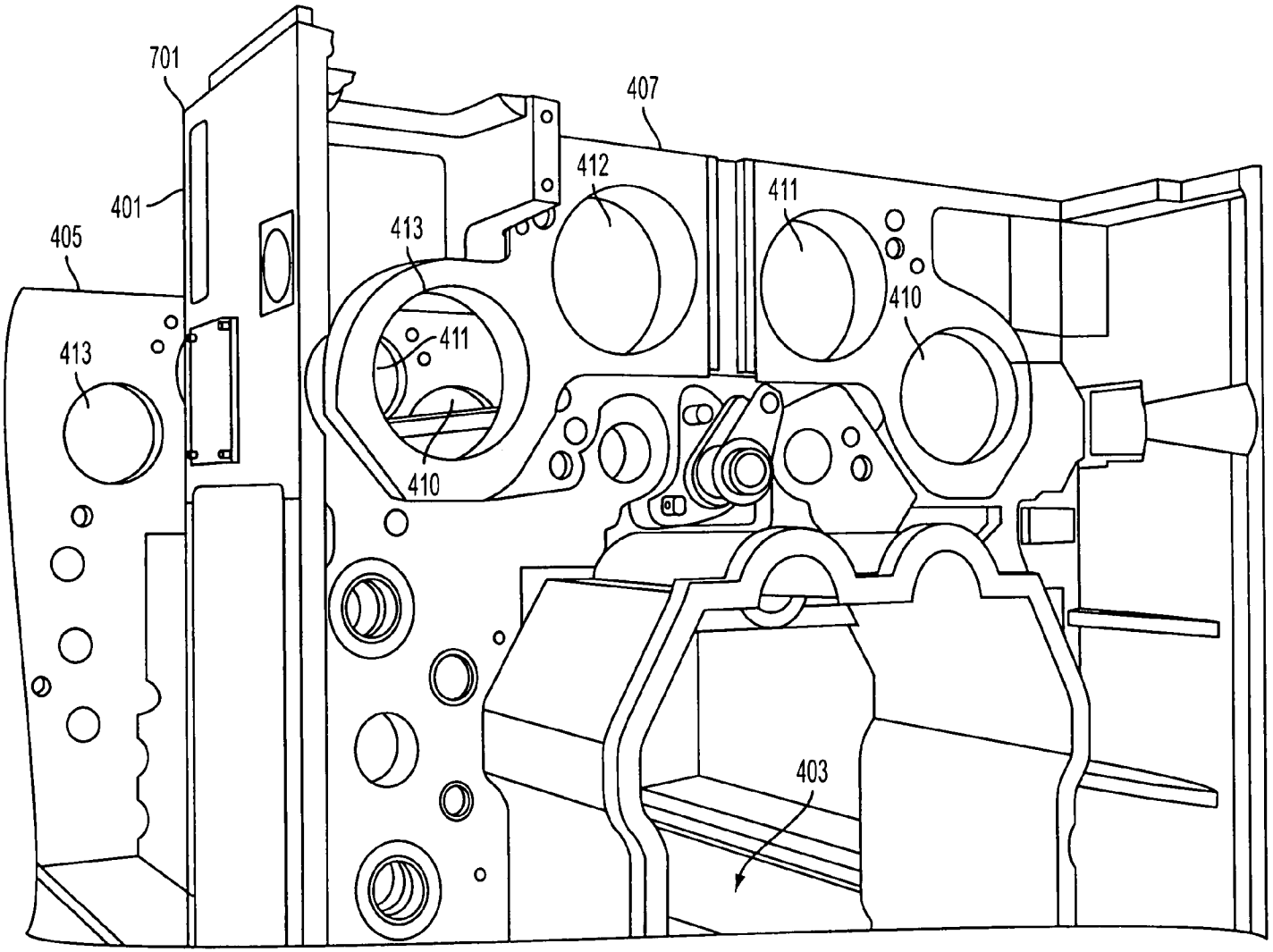
FIG. 2 PRIOR ART
FIG. 2 provides a perspective view of an embodiment of a frame of a standard press unit of the prior art, with the plate and blanket cylinders and the ink transfer and dampener solution transfer rollers removed for clarity.
Figure 5A:
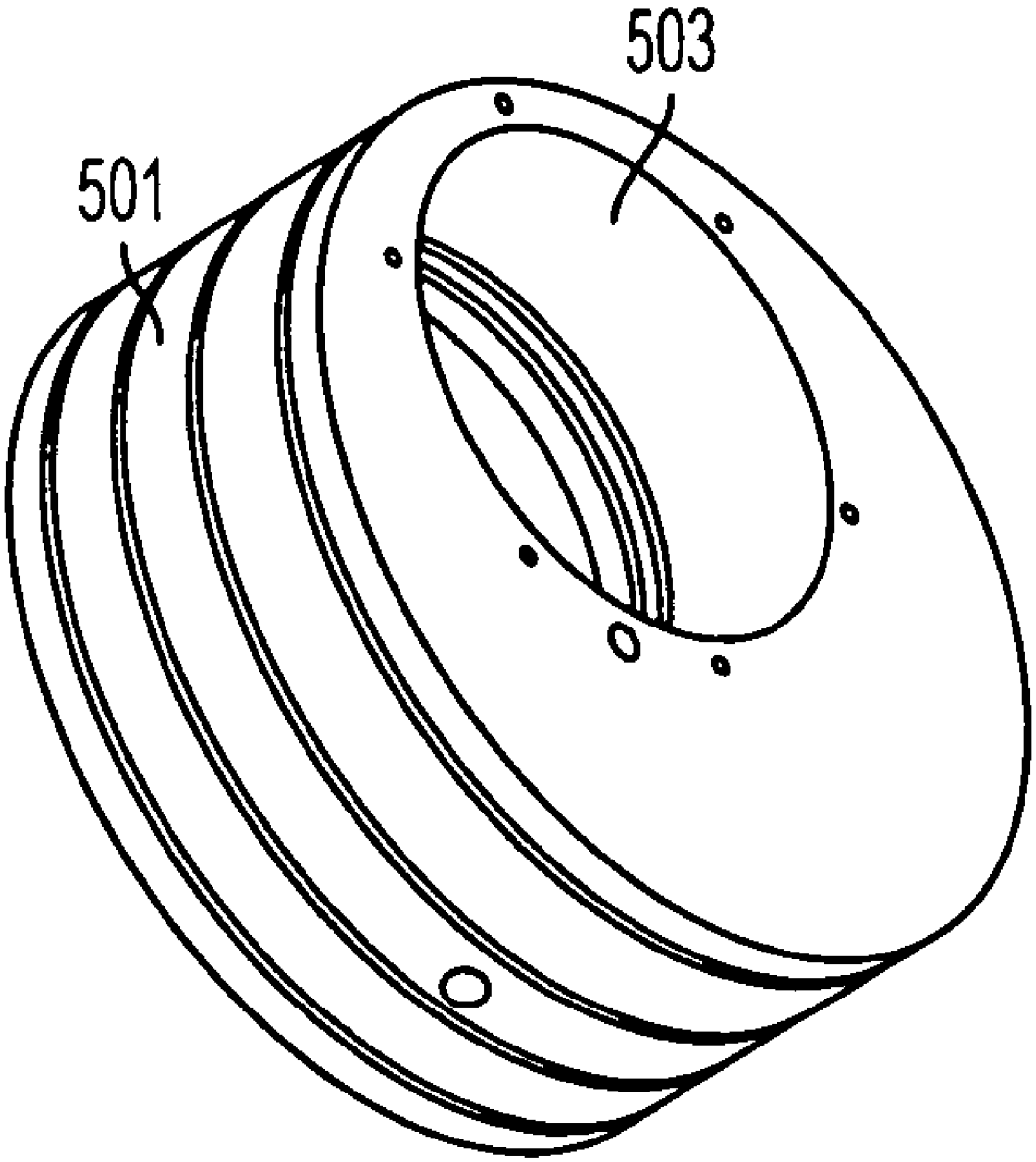
FIG. 5A provides a perspective view of an eccentric sleeve including a mounting hole therethrough.
Figure 5B:
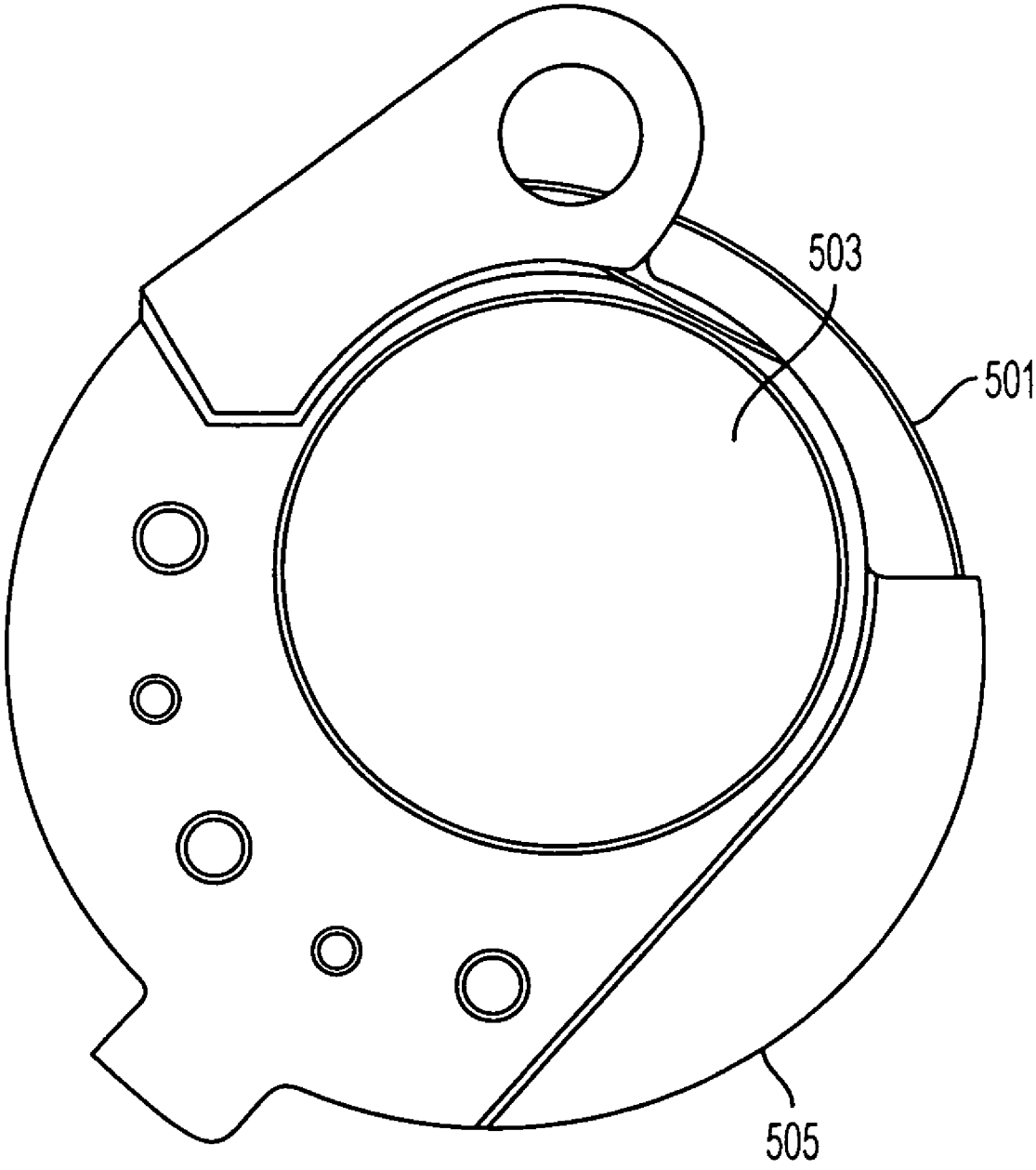
FIG. 5B shows the eccentric sleeve of FIG. 5A with an assembly cap mounted thereto.

Generally, the press unit (101) comprises a large rigid frame (401) generally of cast iron or steel which supports the various cylinders and allows them to rotate appropriately relative to each other. FIG. 2 provides a perspective view of one such embodiment of a frame (401). This frame generally comprises an open sided and open topped trough-style shape having a bottom surface (403) and two sides (405) and (407). Each of the sides (405) and (407) includes a series of four large bore holes (410), (411), (412), and (413) which are mounting locations for the plate and blanket cylinders. These bore holes are essentially identical on each side of the frame (401) so that the cylinders are suspended generally horizontally in the space above the bottom surface between the two sides. For side reference, the bore holes (410), (411), (412), and (413) refer to the positions of the cylinders (10), (11), (12), and (13) as discussed earlier. In order to provide smooth rotation of the cylinders, as well as improved functionality in loading and unloading paper, each bore hole (410), (411), (412), and (413) generally has placed therein a sleeve (501), which is sized and shaped to fit in the bore hole (410), (411), (412), or (413). An example of a sleeve (501) is shown in FIG. 5A. In some embodiments, the sleeve (501) may be allowed to move (rotate) within the bore hole being locked into place generally only when printing is occurring. This may be utilized by a blanket cylinder and may have the sleeve (501) placed in a cap (505) to make machining easier as shown in the embodiment of FIG. 5B or the cap (505) and sleeve (501) may be cast as a single monolithic part to facilitate the movement and removal and replacement of the blanket cylinder. Alternatively, the sleeve (501) may be arranged in the bore hole in a fixed orientation. This is generally utilized by the plate cylinders. Each sleeve (501) has included therein a mounting hole (503). This mounting hole (503) is a generally circular hole arranged within the structure of the sleeve (501) to allow the journal of the appropriate cylinder to rotate therein providing for the axial rotation of the cylinder during printing. The center of the mounting hole (503) therefore corresponds to the rotational axis of the cylinder. To facilitate frictionless rotation, the mounting hole (503) is often lined with a series of ball bearings or similar materials. When assembled, the appropriate cylinder is rotationally connected in a mounting hole (503) towards each end, the corresponding sleeves (501) are mounted in the appropriate bore holes (410), (411), (412), and (413), and the cylinder is suspended between the two sides of the frame (401) so as to be supported by the frame (401).

The sleeve system is often used because the mounting hole (503) may be slightly offset in the sleeve (501) (the mounting hole (503) and sleeve (501) do not share the same axis making the sleeve eccentric) to provide for additional functionality. In particular, the sleeve (501) may be rotated in the appropriate bore hole (410), (411), (412), or (413) (about the axis of the sleeve or bore hole, which is offset from the axis of the mounting in this embodiment) to allow the cylinder associated therewith to be moved into or out of contact with various other cylinders and/or the paper (131).

As should be apparent from these descriptions and FIGS., if smaller cylinders are placed in the various mounting holes (503) and bore holes (410), (411), (412), and (413), the cylinders will be too far away to touch, generally regardless of how the sleeve (501) is rotated. Therefore, there are essentially three different factors which need to be taken into account to use the new cylinders in the existing press frame (401). Firstly, the new mounting hole (503) axis will be translated relative to the existing mounting hole (503) axis. Secondly, this translation will generally also result in a translation of the mounting hole (503) axis from the existing bore hole (410), (411), (412), or (413) axis. Thirdly, the mounting hole (503) needs to be contained within the sleeve (501) (within the bore hole (410), (411), (412), or (413)) to preserve movement of blanket cylinders so as to allow a standard deck (103) to have a half deck (115) or full deck placed thereon to form a three color or four color press unit.

In a first embodiment, the necessary translation related to the first two factors is not enough to place the mounting hole (503) outside the sleeve (501) (and allows sufficient structure of the sleeve (501) to be around the mounting hole (503) for structural integrity). In this case, the refit can be performed by machining a new sleeve (501) where the axis of the mounting hole (503) is moved radially further from the axis of sleeve (501). While in some situations this technique can be used to decrease the size of the cylinders used, it has only limited availability as most of the necessary reductions require translation greater than the available radius of the sleeve (501). This is particularly true with the plate cylinders where the translation may be as much as three times the necessary translation of the mounting hole (503) for the blanket cylinders.

Figure 6:
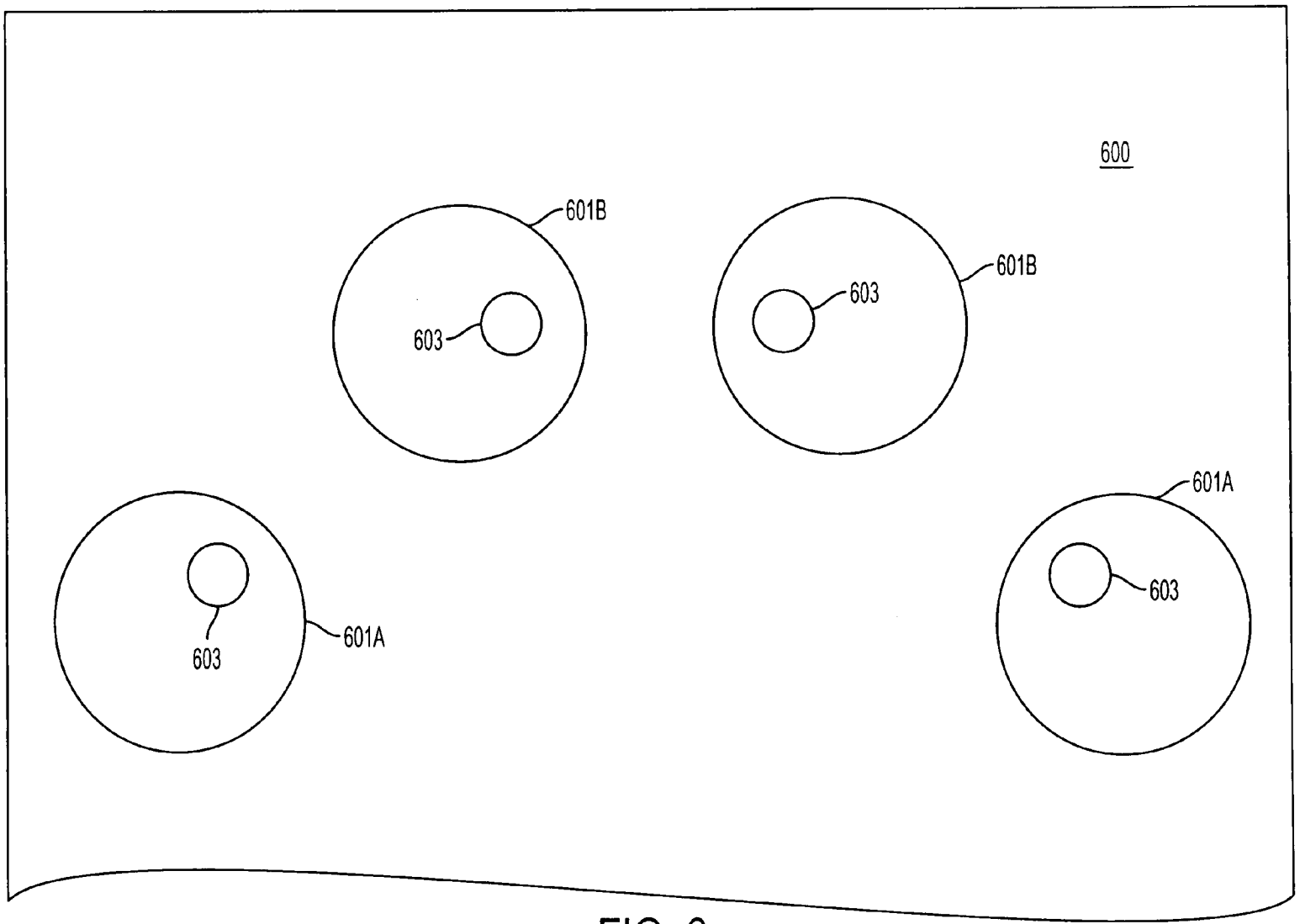
FIG. 6 provides a drawing of the side of a standard press unit showing the bore holes and the mounting holes for the existing plate and blanket cylinders.
Figure 7:
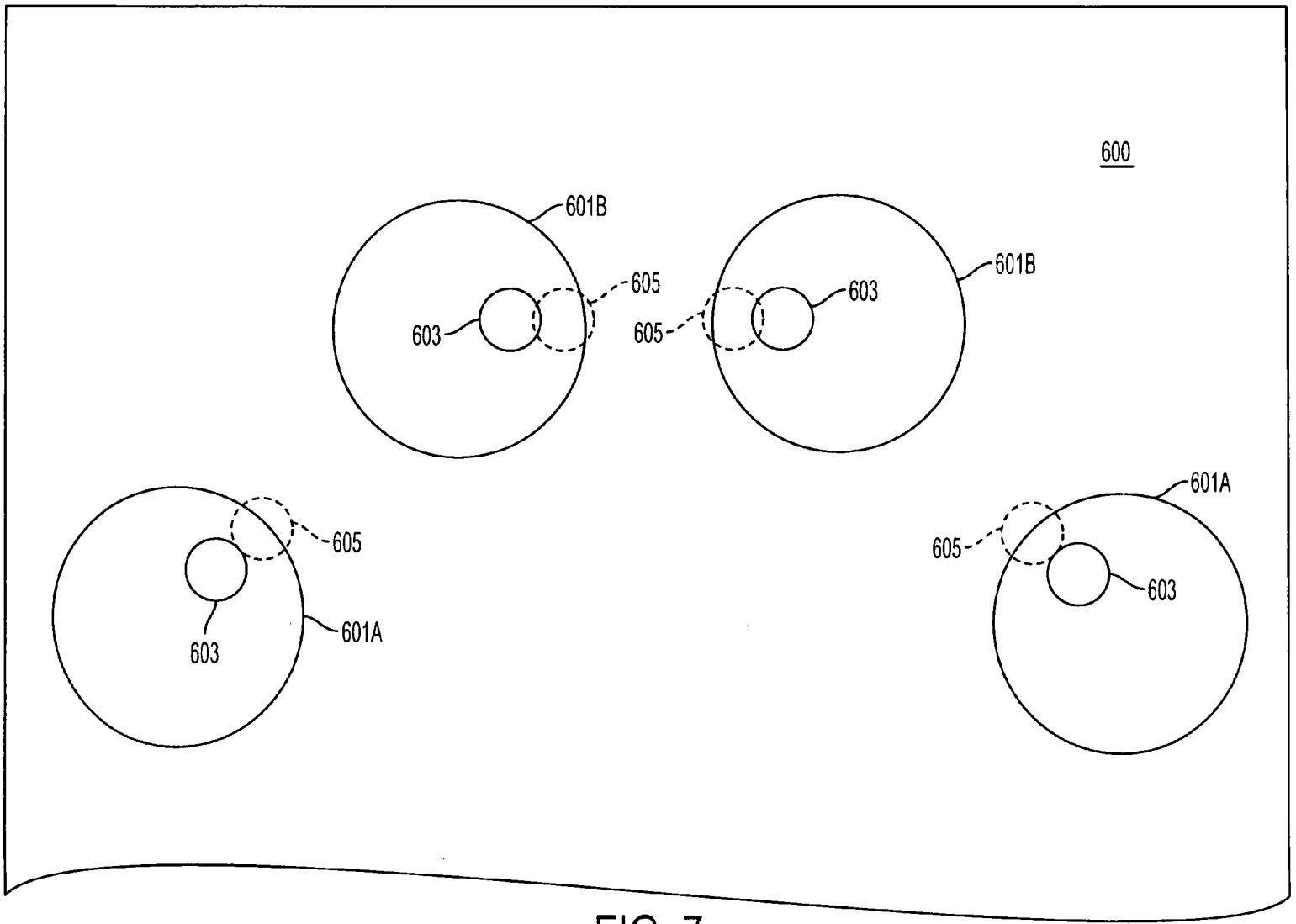
FIG. 7 provides the drawing of FIG. 6 further including a set of dashed circles representing the necessary locations for the mounting holes used by the new plate and blanket cylinders.

In an embodiment of the invention, the linear translation is significant enough that the mounting hole (503) breaches the exterior of the existing sleeve (501). FIGS. 6 and 7 provide conceptual illustrations of a system of this situation. In FIG. 6, there are shown a series of circles from one side of another press frame (600) which show the relationship of the existing bore holes and existing mounting holes. The large solid circles are the original bore holes (601) of the press (with the existing plate bore holes (601A) and existing blanket bore holes (601B) being subgroups), the small solid circles are the original mounting holes (603) of the sleeve. In FIG. 7, this image has been superimposed with small dashed circles which indicate the positions of the new mounting holes (605) to accommodate the smaller cylinders. As can be seen from FIG. 7, the new mounting holes (605) are outside the existing sleeve (overlap the bore holes (601)). Therefore, they would either have to be drilled directly into the frame and sleeve (which would be both unstable and undesirable) or an alternative method would need to be used.

Figure 8:
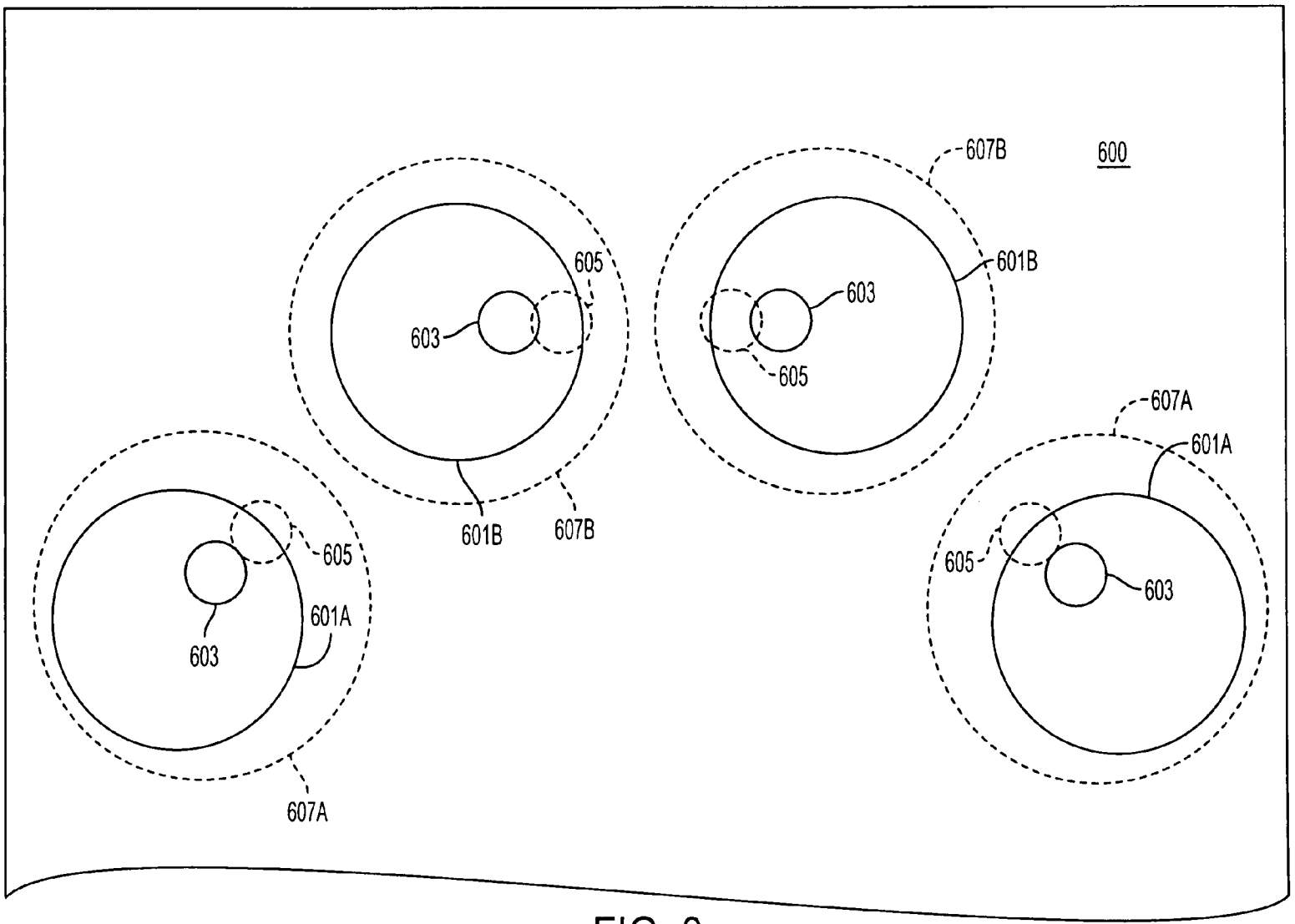
FIG. 8 provides the drawing of FIG. 7 further including a second set of dashed circles representing exemplary bore holes to provide for the use of the new mounting holes of FIG. 7.
Figure 9:
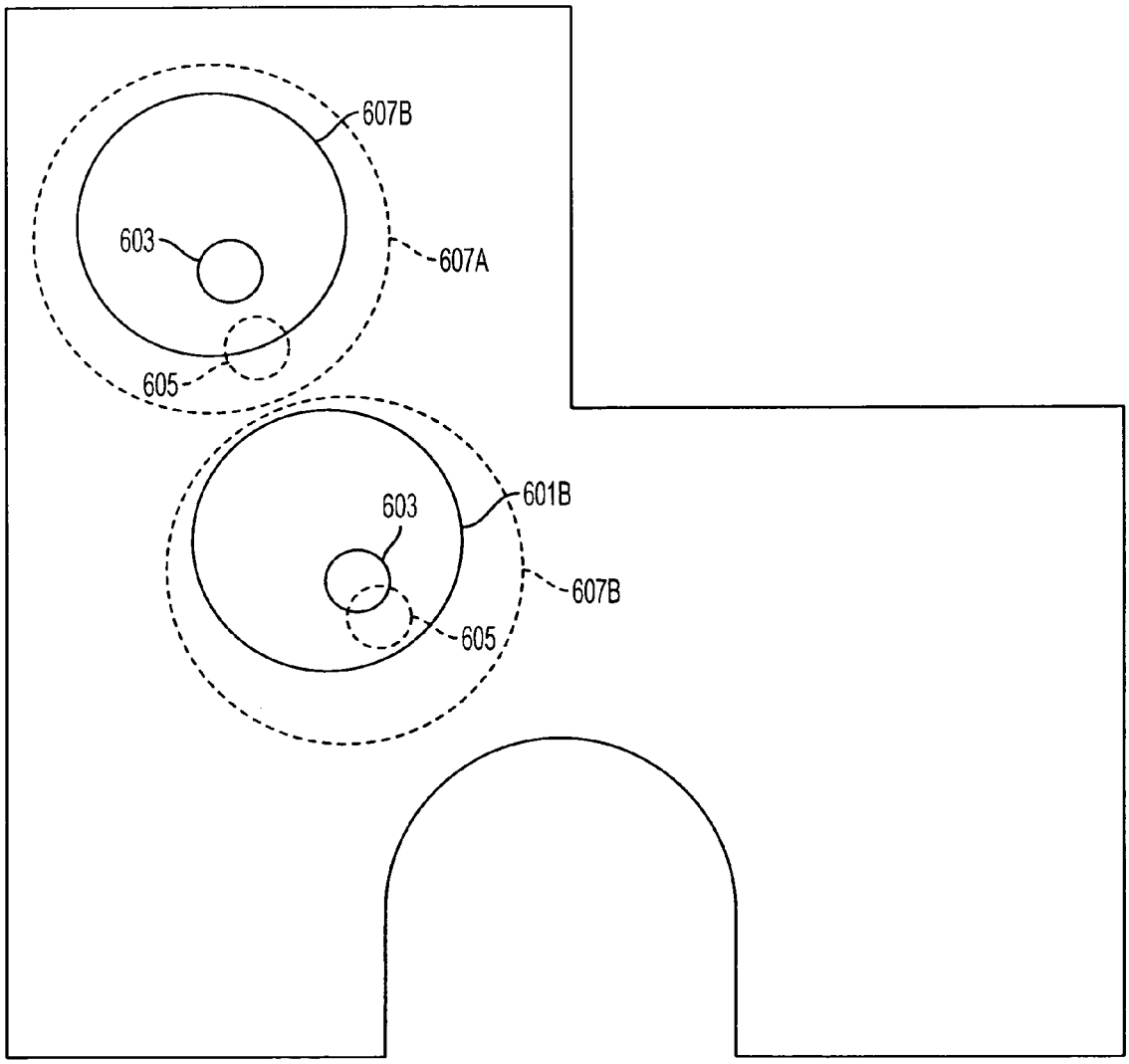
FIG. 9 provides a similar diagram to FIG. 8, but on a half deck module to be attached to the standard press unit of FIG. 8 to construct a three color press unit (a standard press unit with a half deck added on top of it).

FIG. 8 provides for new bore holes to enclose the new mounting holes (605). In FIG. 8 new bore holes (607) (with new plate bore holes (607A) and new blanket bore holes (607B) being subgroups) are provided which encompass both the entire original bore holes (601), and the new mounting holes (605). The new bore holes (607) are larger than the existing bore holes (601) as indicated. Further the axis of the new bore holes (607) may be linearly translated from the axis of the old bore holes (601). So long as these new bore holes (607) are larger and cover the entire area of the original bore holes (601) (encompass the original bore hole (601)), cover the area needed by the mounting hole (605), and do not contact any other new (607) or old (601) bore hole, they can act like the existing bore holes (601). New larger diameter sleeves can be placed therein with mounting holes (605) appropriately placed, and the press frame (600) has been adapted to use the smaller cylinders. A similar drawing to FIG. 8 but for a half deck is shown in FIG. 9. In FIG. 9, in addition to the cylinders of the half deck being able to interact with the common impression cylinder, a three-color press unit generally also requires the cylinders of the standard press unit to be able to operate in conjunction with the common impression cylinder. This design can lead to specific placements of the mounting holes within the sleeves of FIGS. 8 and 9.

While FIG. 8 provides for the system for allowing for the placement of the new bore holes (607), it should be clear that the exact placement of the new bore holes (607) requires precise alignment or else the cylinders will not interact correctly. In addition, the new bore holes (607) need to be machined on an existing press, not simply drawn in a conceptual drawing, and the boring needs to be done in a repeatable and relatively straightforward manner to handle an entire press line and press room conversion. Further, as should be apparent from the conceptual drawing, the actual location of the new bore holes (607) is not really dependent on any specific relationship to the frame, but instead the positioning of the new bore holes (607) relative to each other, and the new bore holes (607) relative to the old bore holes (601) is important as otherwise one of the needed interactions can be lost. Further, the new bore holes (607) in one side of the frame must be accurately aligned to the new bore holes (607) on the other side of the frame so that the cylinders are hung generally horizontally so the press works. Finally, so as to be economical, the operation of boring the holes needs to be relatively straightforward, and can allow for minimal error on the part of a human reconfiguring the press. Because of the design of the press, if a hole is bored incorrectly, the press unit may have to be scrapped resulting in a significant loss of time and money.

The process of trying to precisely align and bore the new holes relative to the old ones can be difficult as the reference items (the existing bore holes (601)) are all circles making determinations of exact horizontal and or vertical dimensions difficult. In order to correctly align the new bore holes (607), the preferred embodiment of the invention utilizes a series of specifically designed guides (called fixtures) to provide for straightforward repeatable boring operations to be performed on the frame.

One such series of these fixtures is shown in FIGS. 10–14 of U.S. patent application Ser. No. 10/458,790, the entire disclosure of which is herein incorporated by reference. In that series of fixtures, new bore hole alignment was performed by using two sets of fixtures, one that aligned the new blanket or plate holes to the existing other set of holes, and the other which aligned the other of the new blanket or plate holes to the previously bored new holes.

While this is an effective way to align the new bore holes, in many cases when a press has been in use for many years, the existing bore holes may have moved from their originally aligned position over time. Such movement can be caused by flexing of the frame or through wear in the old bore holes making them slightly larger than is anticipated. As the position for the new holes was aligned based on circle parts which were used to find the center of the existing holes, this slight wear could result in the determined axis of the old holes not being in the expected location, and slight misplacement of the new holes. While this slightly altered position may not be readily noticeable when the current cylinders are used, using these bore holes for alignment can result in slight problems being exaggerated.

For these reasons the system herein uses the axes of these holes in conjunction with alignment to an external corner (701) of the frame (401). While the frame (401) can also suffer from wear issues, it is less likely as the corner (701) would generally not support any moving parts and is generally not as subject to wear as the old bore holes are. The particular corner chosen for a standard unit is the top corner associated with the 12 and 13 side of the press frame (the corner above hole (413) as seen in FIG. 2). While the other corner could be used, this corner (701) is selected because it would have been used, in many presses, to align the boring of the original bore holes when the press was first built.

In particular, when a press unit frame is originally formed, it is common practice to bore both sides of the frame (401) simultaneously to prevent and discrepancies in placement between the two sides. To align the two sides with each other, and to provide for alignment with the boring mechanisms, corners of both the drive and operator side are aligned with each other, and all four of the existing bore holes were drilled through both pieces simultaneously to provide for clear symmetry. By aligning the new bore holes off the same corner as the old bore holes were originally aligned to, both the plate and the blanket holes can be bored using a single template set, and slight errors in position caused by wear or through slight misplacement in the original setup can be detected. In effect, this means that the new bore holes may be more precisely aligned than the old bore holes are aligned at the time of drilling. It also provides for a series of double-checks to improve accuracy and placement.

Figure 21:
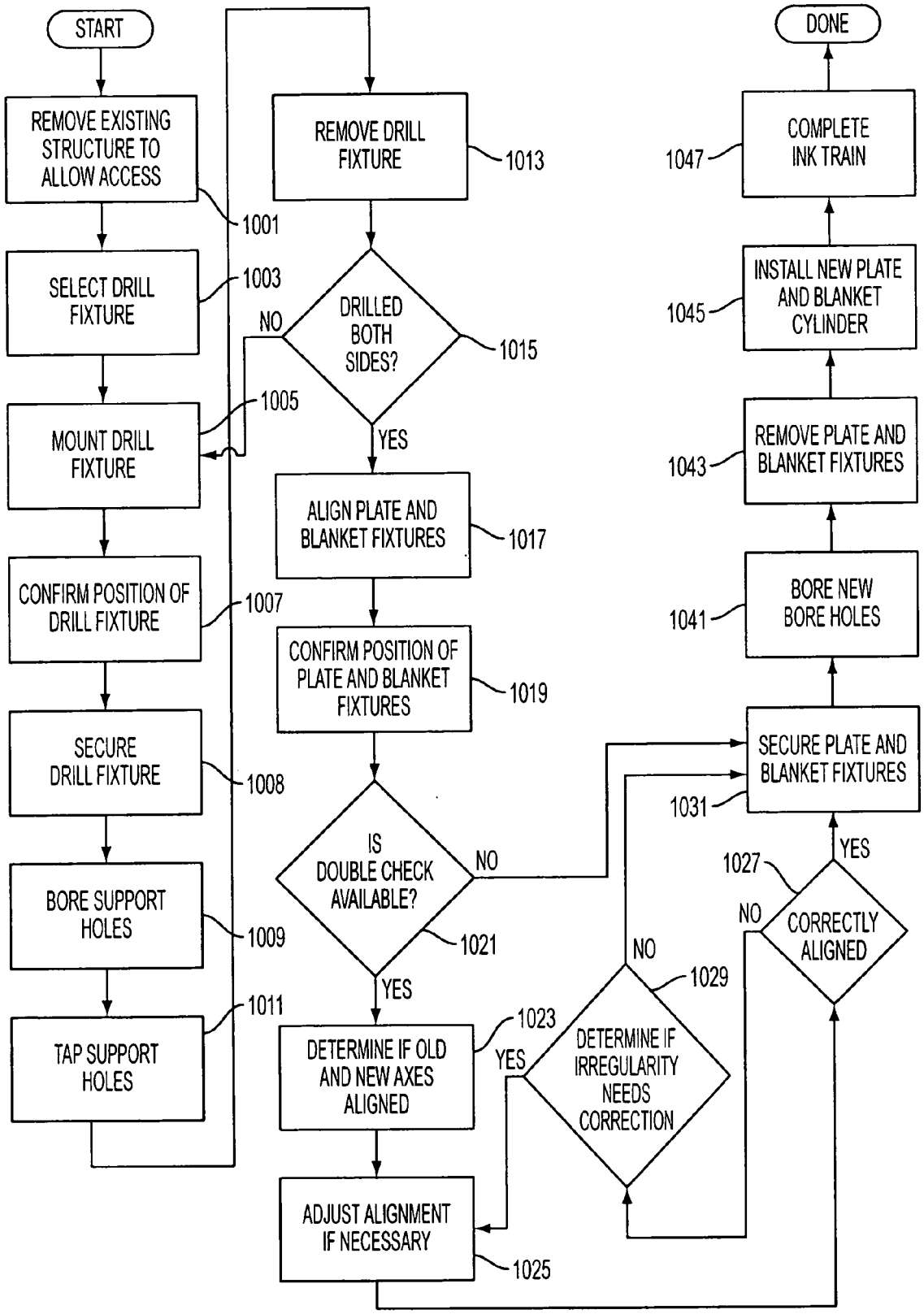
FIG. 21 provides for a flowchart of steps used to machine new bore holes in an existing frame for use with smaller diameter plate and blanket cylinders.

FIG. 21 provides a flowchart of an embodiment of a manner of use of fixtures to machine the new bore holes (607A) and (607B) in a standard press unit. These steps would generally be performed by an operator or work team who is boring the press unit. Further, the arrangement of steps in FIG. 21 presumes that the fixtures are being used to bore all holes on both sides of a single press unit, and then the operator is moving to a new press unit. In an alternative embodiment, multiple sets of fixtures and/or multiple work teams or operators could be simultaneously performing steps on different press units.

An operator in step (1001) first removes the existing plate and blanket cylinders and the sleeves from the press unit frame and removes any ink and/or dampening rollers and other structure that may be necessary to access the sides of the press to place the fixture and to use the boring machine. Generally, access to the side will be obtained and the boring machine and fixture will be placed inside the frame of the press where the cylinders generally would be placed so that little external space is needed. The depiction of FIG. 2 shows a frame in this state.

Figure 10A:
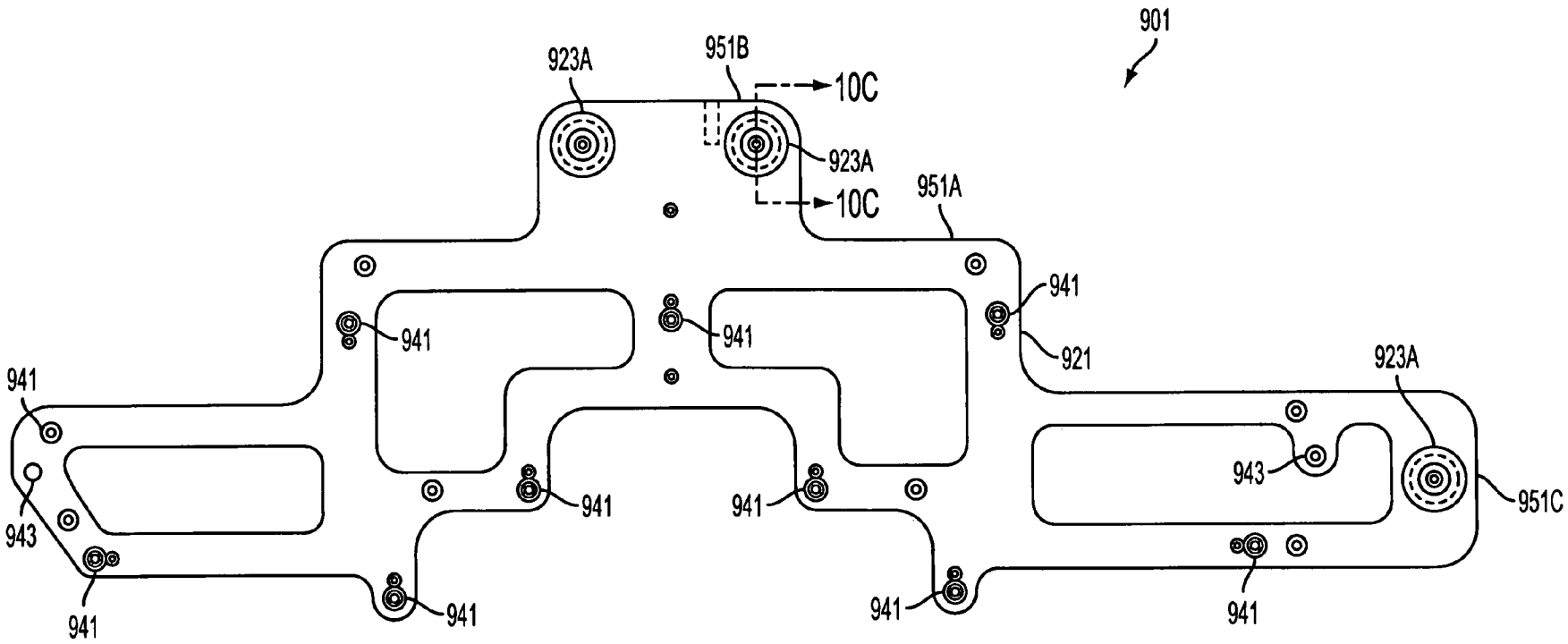
FIG. 10A provides a front view, FIG. 10B provides a top view and, and FIG. 10C provides a cross sectional view through an alignment pin.

Once the operator has access to the desired side of the press unit, a drill fixture, such as the one shown in FIG. 10 is selected in step (1003). The drill fixture is designed to allow for the positioning and machining (or boring) of support holes to allow for more accurate placement of the plate and blanket bore aligning fixture used later. The drill fixture will be positioned in step (1005) on either the drive and operator side of the press depending on which side is to be acted on first. This positioning will be the placing of the alignment pins in contact with the external top and side surfaces of the press frame and associated with the corner (701). In step (1007) the position of the drill fixture is confirmed to be accurate both by the alignment pins and by using various alignment surfaces on the drill fixture. Once correctly aligned on the press frame, the drill fixture is rigidly attached to the press frame in step (1008) by attaching bolts through holes in the press frame and corresponding alignment holes in the drill fixture. Once rigidly attached, a boring machine or drill is brought up and is used to bore various support holes into the frame in step (1009). These support holes may be sized and shaped, in an embodiment, so that the holes may be used later on in the conversion process for the mounting of other drums or cylinders or other devices which need to be attached to complete the conversion, but such use is not required.

Once the support holes have been drilled, they may be tapped to enable the connection of screws in step (1011). The drill fixture is removed in step (1013). In step (1015), it is determined if both the drive and operator sides of the press have had support holes drilled. If one side has not been so drilled, the prior steps are repeated to drill support holes on the remaining side using the opposing face of the drive fixture. Once both sides have had support holes drilled, the plate and blanket aligning fixtures are aligned on the press in step (1017). As in the drill fixture before them, the plate and blanket aligning fixtures are aligned relative to the selected corner of the press by placing alignment pins in contact with the top and side of the press frame associated with the appropriate corner.

Again, in step (1019), the alignment is confirmed using various aligning surfaces on the plate and blanket aligning fixtures relative to the surfaces of the press frame. In the preferred embodiment disclosed, the axis of the new bore hole for the blanket cylinders is intended to be aligned with the axis for the old blanket cylinders and a double check test can be performed beginning in step (1021).

A revolving ultrasonic measurement tool or other high precision measurement device for determining the axis of a hole is used to determine if the two axes of the bore hole in the fixture and the old blanket bore hole are aligned in step (1023). This precision will generally be down to the thousandth of an inch. If the alignment is not precise in a systematic way, in step (1025) the fixture may be adjusted so as to correspond the axis. Once the step (1025) has completed, there is a determination in step (1027) if now both the corner and axial alignment are correct. In most cases they should be indicating that the fixture is now correctly positioned on the frame. If, however, there is an irregularly in the axial position (as may be the case due to wear) or the corner position (which may be the case due to damage or wear) in step (1029) the user determines if there is an irregularity and attempts to pin down what has caused the irregularity. The user also determines how to handle the irregularity.

An irregularity will generally result because one of the selected measurements surfaces (frame edge or existing bore hole) may have worn over time and therefore no longer provide an accurate measurement. For instance, the user may precisely measure the shape of the existing blanket bore hole and determine that the hole is not perfectly circular, probably due to wear, the axial alignment may therefore be imperfect.

Once the determination has been made, the user will decide how to treat the irregularity. In most cases, the irregularity will be in the axial positioning, and the user may choose to utilize the new axis points instead of the old to effectively remove the irregularity. In such a situation only the corner and surface alignment may be used to place the template.

Once the fixture is correctly aligned, the plate and blanket aligning fixtures are rigidly screwed into the support holes in step (1031). Once both plate and blanket aligning fixtures are attached (one on each of the drive and operator sides of the frame) a boring machine is supplied in step (1041) connected to which hole(s) is to be bored first. The boring machine will be used to bore all four new bore holes in each side of the frame. These holes may be bored one at a time or corresponding holes on either side of the frame may be bored simultaneously. Once all four have been bored, the plate and blanket aligning fixture is removed in step (1043).

After the plate and blanket aligning fixture set is removed, the new plate (607A) and blanket (607B) holes have been bored for both sides of the frame. The new plate and blanket cylinders are now placed in the appropriate new plate (607A) and blanket (607B) holes in new sleeves in step (1045). Due to the alignment of the positions for boring during the operation, the cylinders are correctly aligned to be used once so hung. Once the plate and blanket cylinders are placed, additional cylinders, drums, and objects may be reattached to the press to complete the ink train in step (1047). These may be placed in their old holes, may be placed in the support holes as discussed below, or may have new holes drilled. Once all necessary materials have been reattached to the press, the retrofitting is completed.

The steps of the method shown in FIG. 21 should be recognized as merely exemplary of how the action of boring the holes could be performed. In addition, in other embodiments, additional operations could be performed either before, during, or after these steps of FIG. 21. Bore holes for ink drums, other rollers used in the press unit, or other mechanisms may also be modified so that the press correctly transfers ink and dampener solution to the new plate and blanket cylinders, and so that the modified press unit correctly functions with the other components of the press line. These may be bored, in an embodiment, using the support holes as a basis for their location or may be done entirely independently. Further, drive mechanisms or related structures may also be modified as necessary to interact with the new cylinders. Specifics of these modifications are beyond the scope of this disclosure which is focused on the critical positioning of the blanket and plate cylinders.

As can be seen from the above, this methodology provides for a single fixture which, once attached to the frame, allows the new plate and blanket bore holes to be drilled without moving, removing, or adjusting the fixture. This can help to more accurately align most of the holes used with each other. In particular, the accuracy of the placement of the holes is essentially dictated by the accuracy in the construction of the plate and blanket fixtures.

As these fixtures are reusable through a plurality of different cut off reduction operations on similar presses, it is cost effective to have a very high degree of accuracy in the machining of the fixtures as they can be reused and the higher the accuracy often the more likely that the resultant plate and blanket layout will function as intended.

Further, because the system provides for a double check based on both corner placement and axial placement in the case where axes are aligned between the old and new holes, slight discrepancies in the individual machine's design, due to wear or possible slightly miscalculated arrangements in original boring, can be detected, and eliminated with the new bore holes being much more accurately positioned. Further, because the axial alignment is a double check, the user can determine if the axial discrepancy is due to wear (which would generally lead to an indication that the new holes should be bored in a manner to eliminate the discrepancy) or if the discrepancy might be due to an original miscalculation of bore placement in the original press which may indicate that the fixture should actually adjust to take into account the prior miscalculation to provide for better placement or that both sides of the press need to include similar adjustments to compensate.

As is clear from the above, the bore positioning is performed through the use of a series of fixtures to determine placement. One embodiment of fixtures which may be used are described in conjunction with FIGS. 10–20. These FIGS. provide a series of fixtures for use with standard press units and also half deck units. One of ordinary skill in the art would understand that the principle discussed in conjunction with these components may be extrapolated to build fixtures for full deck, tower, or other units.

Often a set of fixtures is used wherein one set of fixtures is used in conjunction with the drive side of the frame, while the other is used in conjunction with the operator side of the frame. Other times the reversed sides of a single fixture may be used. It would be apparent to one of ordinary skill in the art, that these are similar arrangements and therefore this discussion may focus on the use of a fixture, and then the use of a fixture having a mirror image to show how actions on one side of the press are translated to the other.

The first fixture discussed is the drill fixture (901) and embodiment of which is shown in FIG. 10. The drill fixture will generally be a single fixture useable on one side in conjunction with the drive side of the press and on the other with the operator side of the press. However, in an embodiment, two different drill fixtures may be made to comprise a drill fixture set. This is the case with the half-deck example discussed later, for example. One of the fixtures in the set is generally used on the drive side of the press while the other is used on the operator side of the press but need not be used in such a manner.

The drill fixture (901) is generally used for boring the support holes which will later be used to secure the plate and blanket fixture (801) based on positioning of various structures relative to the "13" corner (701) of the frame. These support holes may also be used later in the conversion to support, or as the basis for boring a support, for other drums, rollers and mechanisms for use in completing the adaptation of the press.

The drill fixture (901) in the depicted embodiment is comprised of a frame (921), which is preferably constructed of a strong rigid material, such as, but not limited to, steel. The frame will generally be fairly open in structure to provide for decreased weight but will be designed to be sufficiently strong and rigid to support boring operations without significant flexing. The drill fixture (901) includes at least one and generally a plurality of support hole guides (941) as well as two alignment holes (943).

Figure 10B:
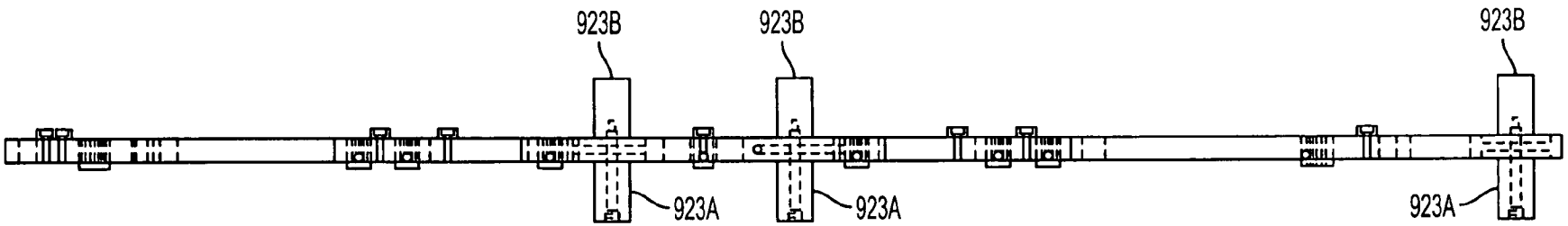
FIG. 10 provides various views showing a drill fixture for boring of support screw holes on both the operator and drive side of the press unit frame.

The alignment of the drill fixture (901) of the depicted embodiment is performed through the use of corner and edge alignment. In particular, the drill fixture (901) includes three aligning pins (923) which extend from the frame of the drill fixture (901). These pins (923) are all carefully machined and arranged so as to be very close to cylindrical about their known axis. They are then attached to the drill (901) fixture through bolts (925) or other attachment structures. The pins (923) are arranged so that two pins (923) are on the top of the drill fixture (901) and arranged linearly to each other while the other pin (923) is arranged on the side of the drill fixture (901). The pins are generally arranged on both sides of the drill fixture (901) placing each of the three pins in position to extend from both sides of the drill fixture (901) as pins (923A) and (923B) as shown in FIG. 10B.

Figure 10C:
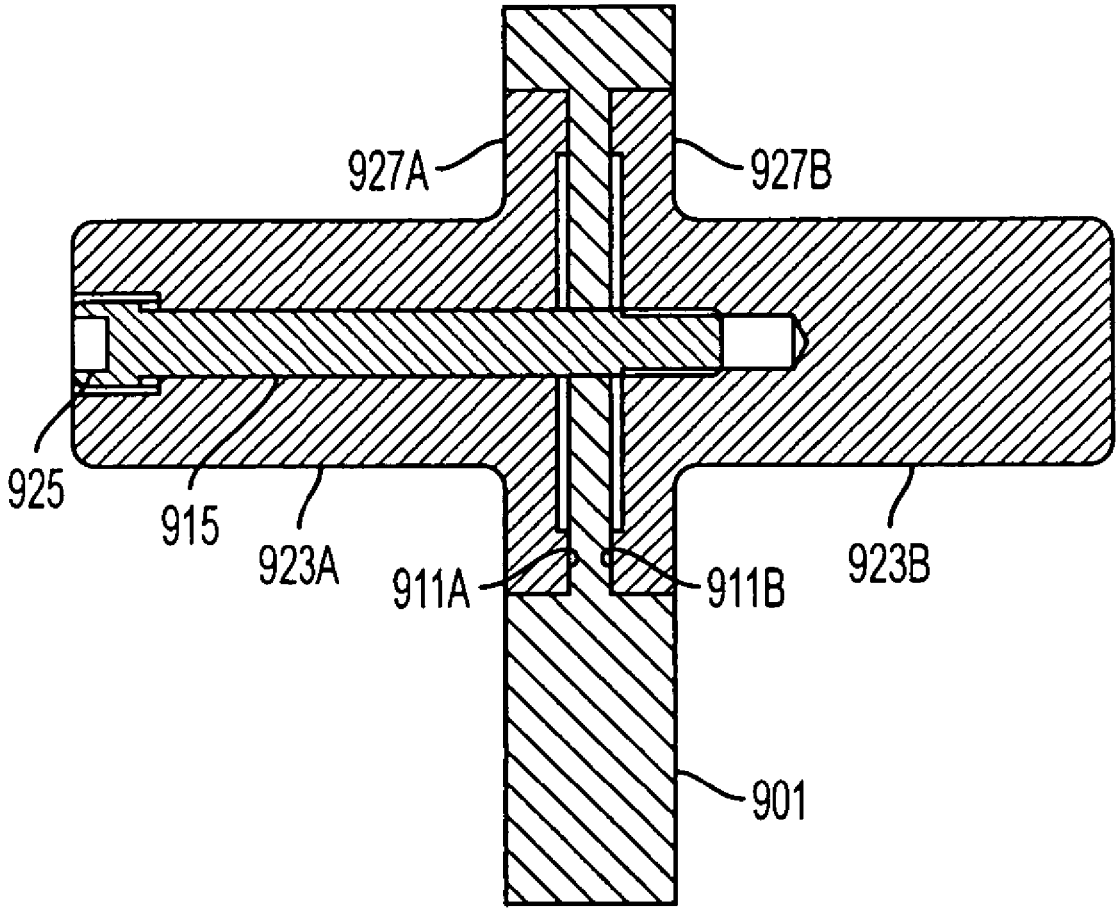

FIG. 10C provides a cut-through drawing of an embodiment of both aligning pins (923A) and (923B) showing how the pins are attached to the fixture (901). In this embodiment, the generally cylindrical pin is constructed with a base at one end forming an alignment and support disk (927) which sits in a recessed orifice (911) in the fixture (901). As only a single drill fixture (901) is used for both sides of the press unit, there are two pins (923A) and (923B) arranged back to back. As can be seen, co-parallel with the center axis of the alignment pin is a bolt hole (915). The bolt hole (915) extends through one pin (923A) and into the other (923B). In this way, the two attachment pins are attached to the fixture placing each alignment and support disk in the appropriate hole, and then are held in place by a single bolt (925) running through their axes. This arrangement provides the benefit that the two corresponding alignment pins (923A) and (923B) are generally arranged on the same axis so that both sides of the press are measured similarly by using the opposing sides of the drill fixture (901).

Beyond the alignment pins (923A) and (923B), the shape of the drill fixture (901) is also chosen to provide for at least two alignment surfaces (951). These surfaces are designed to be arranged so as to be square with the line of the alignment pins (923). In particular, the alignment surfaces (951A) and (951B) are designed to be generally parallel with the line connecting the axes of the two alignment pins on the same side. Further alignment surface (951 C) is designed to be generally perpendicular to alignment surfaces (951A) and (951B) and therefore perpendicular to the line between the two pins.

Figure 15A:
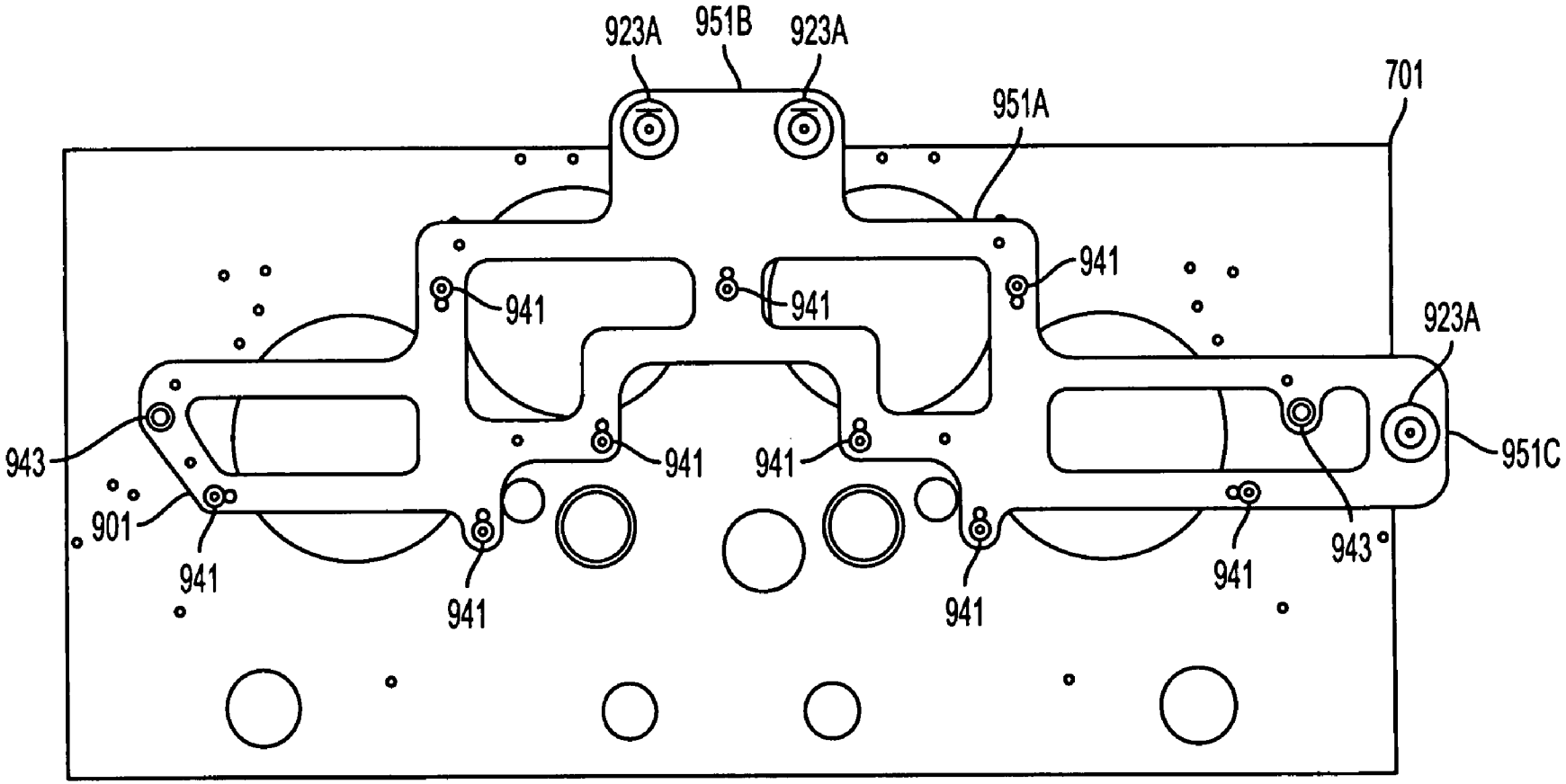
Figure 15B:
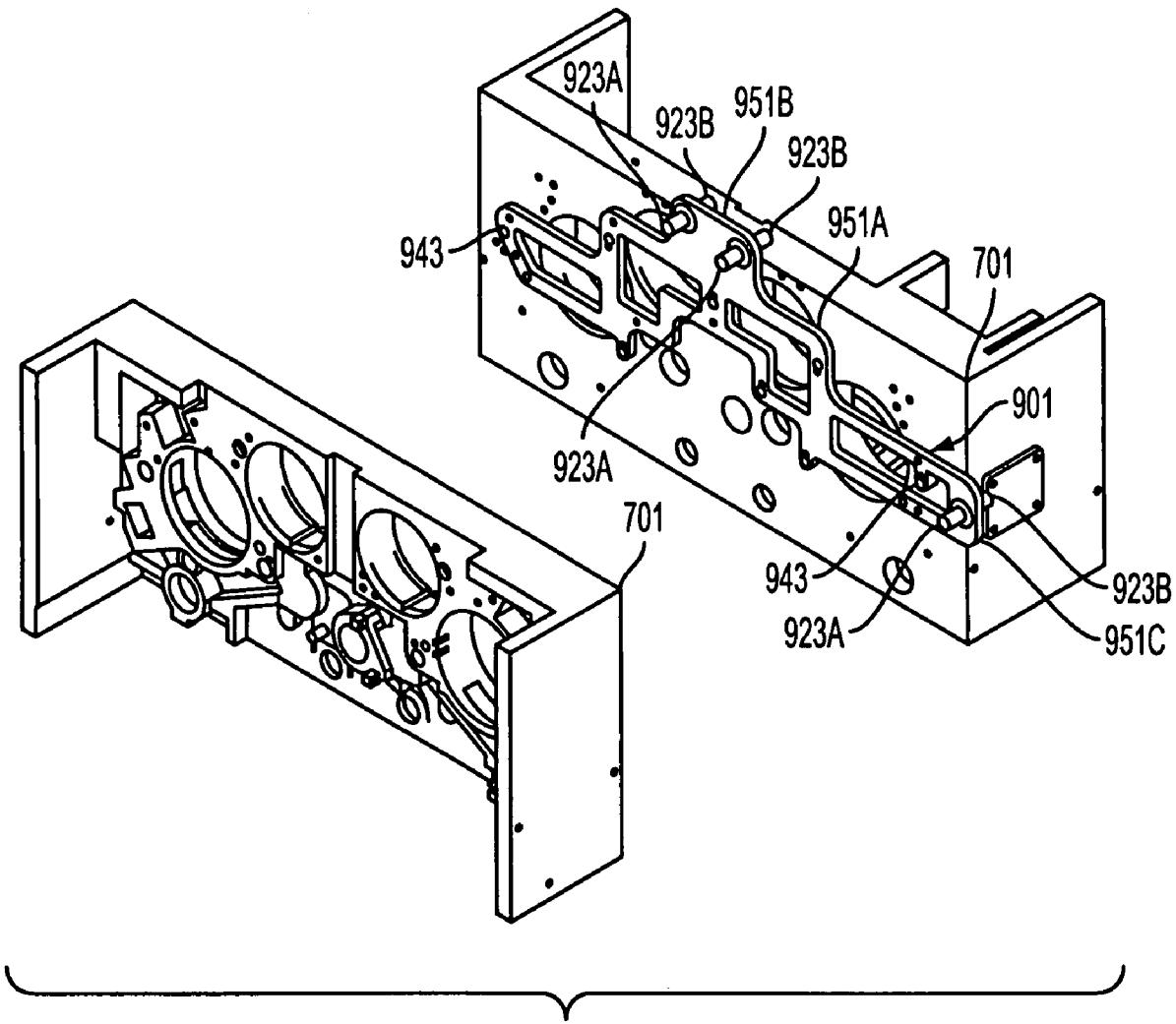
FIG. 15B shows a perspective view.

FIG. 15 shows the drill fixture (901) in place on the drive side of a press unit and indicates how the drill fixture (901) is squared to the press unit. In particular, the drill fixture (901) has been placed so that the two alignment pins (923B) on the top of the drill fixture (901) rest against the top surface of the press unit and the other alignment pin (923B) rests against a side of the press unit. This placement defines the drill fixture's (901) location relative to the corner of the press unit. The user will generally measure from the sides and top to the alignment surfaces (951A), (951B), and (951C) of the drill fixture (901). Presuming the corner is square and the drill fixture (901) is correctly aligned, the distance from the side or top of the press unit to the alignment surfaces (951A), (951B), and (951C) of the drill fixture (901) should be constant over the length of the alignment surface (951A), (951B), and (951C). The fixture may be adjusted to make the surfaces parallel if there seems to be a slight misplacement.

To hold the drill fixture (901) to the press unit during boring of the support holes, there may be two alignment holes (943) in the fixture (901). These may be designed to align with old ink train holes on the press unit used for a purpose other than the plate or blanket cylinder support when the drill fixture (901) is in place on the press unit.

Once the position of the drill fixture (901) is determined to be satisfactory, the drill fixture (901) is attached to the press unit by placing screws, bolts, or other objects through the alignment holes (943) and into the holes of the press unit which correspond for clamping the drill fixture (901) to the press unit. Once attached, the alignment may be double checked. As the drill fixture (901) is now aligned as it should be with regards to the corner, support holes may be drilled into the press unit by boring using the support hole guides (941) to determine the appropriate location. The support hole guides (941) are generally holes in the drill fixture (901) which are designed to align with appropriate places to support the later plate and blanket fixture (801). While these support hole guides (941) may be arranged in virtually any location, in the depicted embodiment they are arranged because they are related to holes which may be needed for later attachment of other objects related to the use of smaller plate and blanket cylinders. Once all support holes have been drilled, they will generally be tapped for screws.

The drill fixture (901) is removed once the support holes have been drilled as the drill fixture (901) is preferably not used for boring any of the plate or blanket holes. As discussed above, generally the same drill fixture (901) will be used to drill the support holes on both sides of the press unit. In this way, once the drill fixture (901) has been used to align the support holes on one side of the press unit, the same drill fixture (901) may then be used to align the support holes on the other. As should be apparent, as the two sides of the press unit were clamped together with the bore holes drilled in both pieces simultaneously based on the location of a corner, reversing the drill fixture (901) for use allows the same fixture to be used to align based on the corner that would have previously been aligned on both halves of the structure. Therefore any systematic errors in the press unit should remain systematic in the alignment.

Figure 16A:
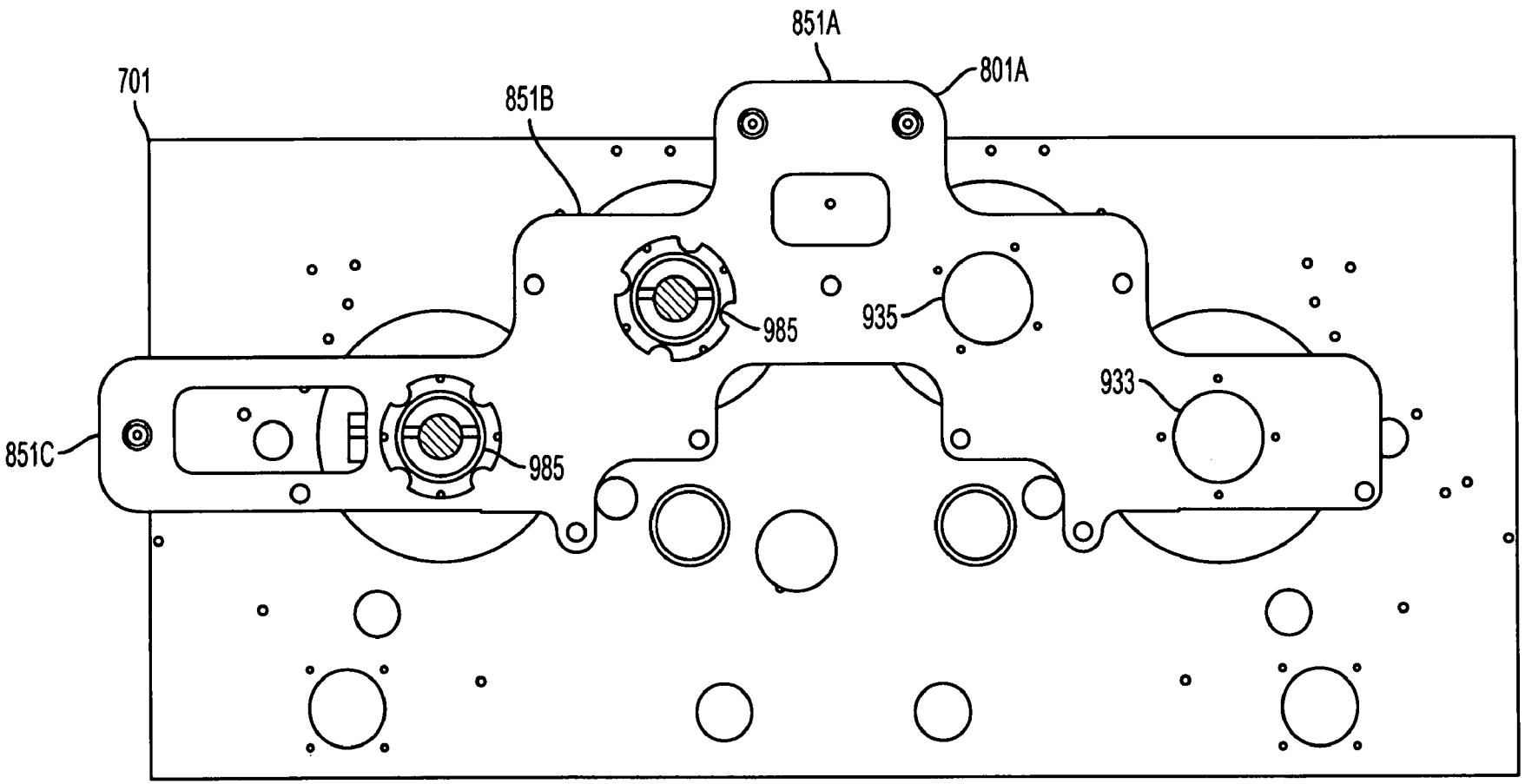
Figure 16B:
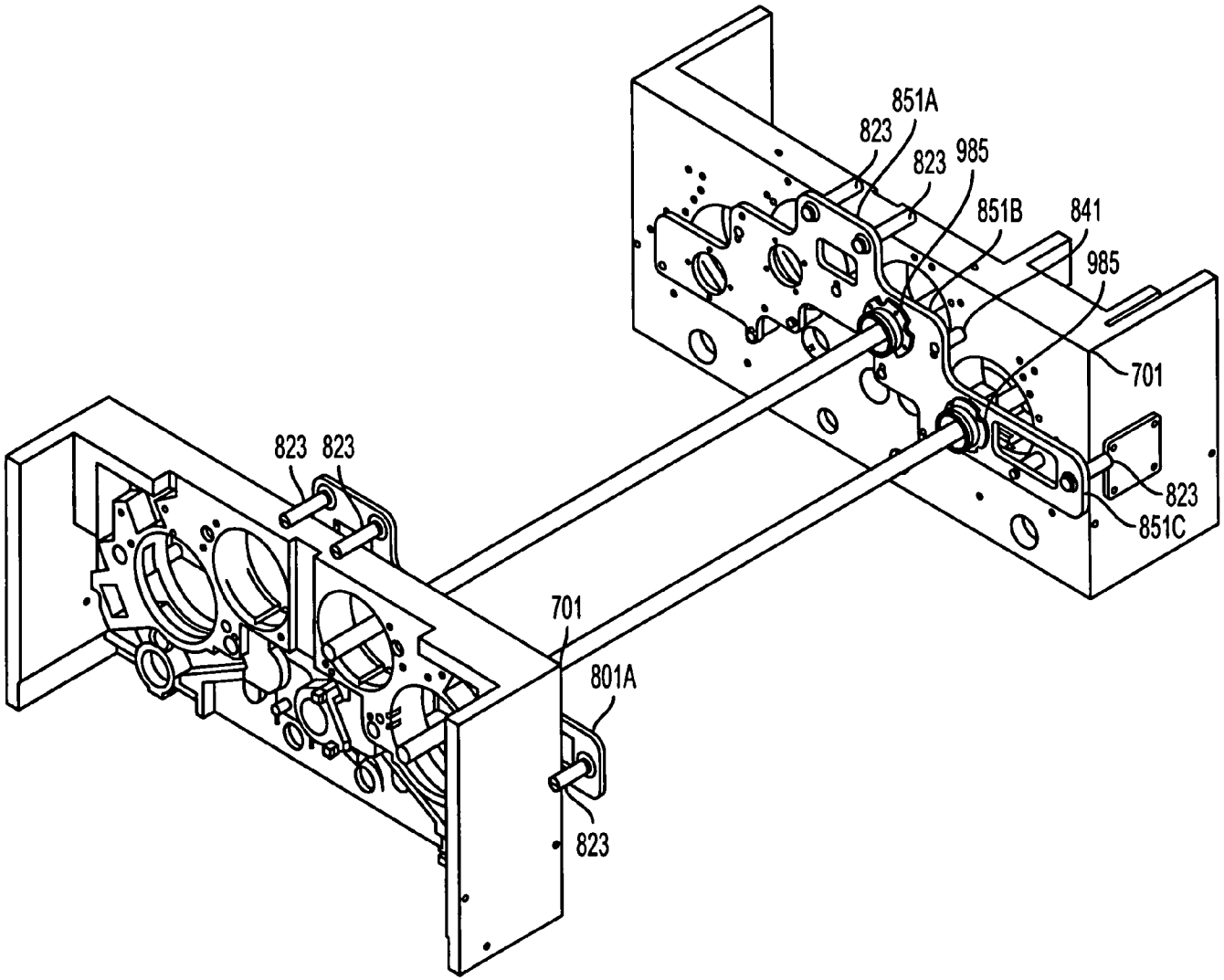
FIG. 16B shows a perspective view of both sides.

Once the drill fixture (901) is removed and both sides of the press unit have had the support holes drilled, the plate and blanket fixture set (801) is used. As opposed to the drill fixture (901) of the embodiment of FIG. 10, there are generally two fixtures (801A) and (801B) comprising a plate and blanket fixture set (801), one plate and blanket fixture for each side of the press unit with each placed simultaneously as shown in FIG. 16B. In an alternative embodiment, a single plate and blanket fixture (801) may be used for both sides of the press unit in the same manner as the drill fixture, however, the use of a set of units can provide alignment benefits as discussed below.

Figure 12A:
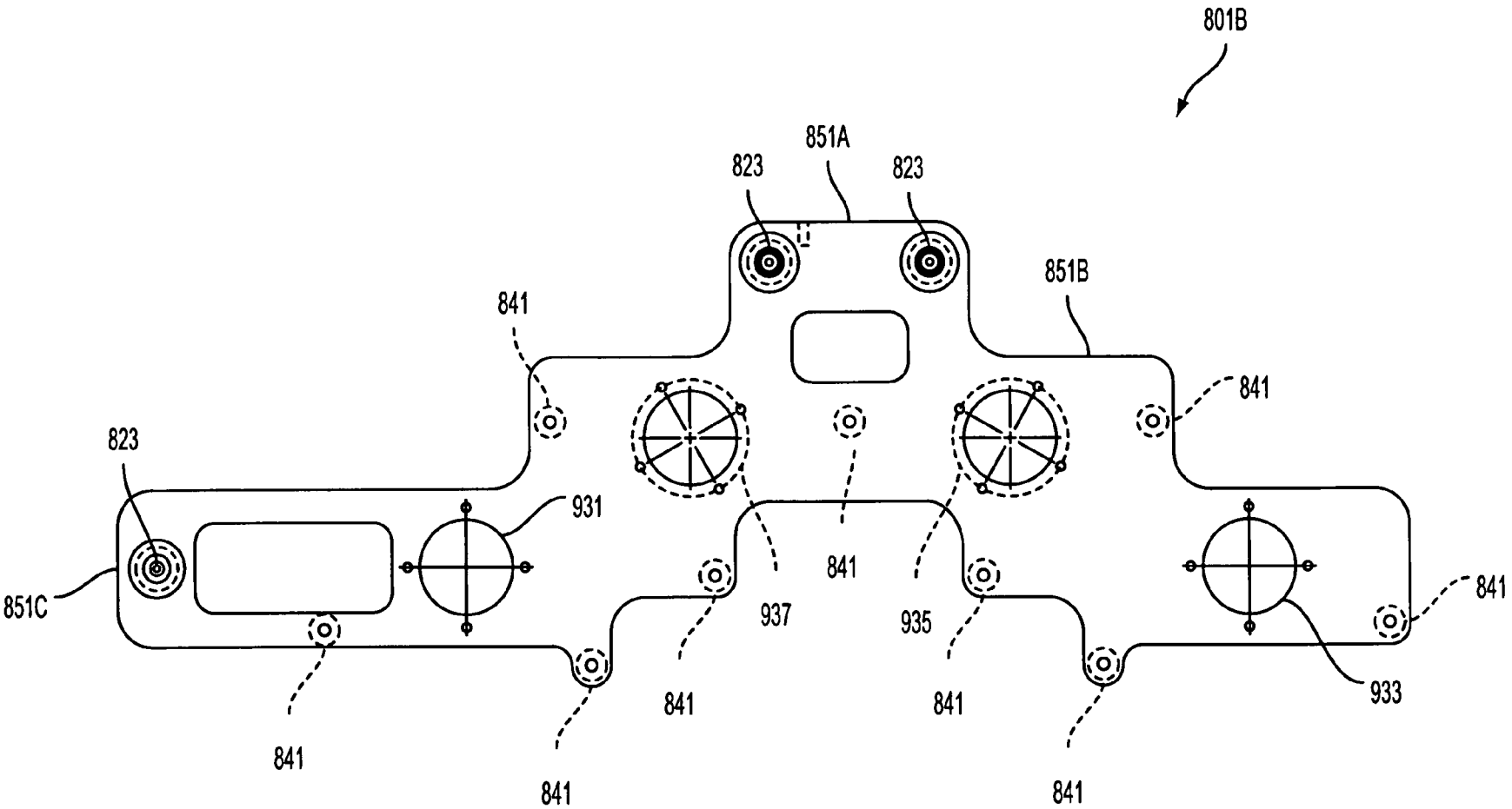
FIG. 12A provides for a front view while FIG. 12B provides for a top view FIG. 13 provides a view of the embodiments of plate and blanket bore aligning fixtures of FIGS. 11 and 12 arranged face to face as they would be machined.
Figure 12B:
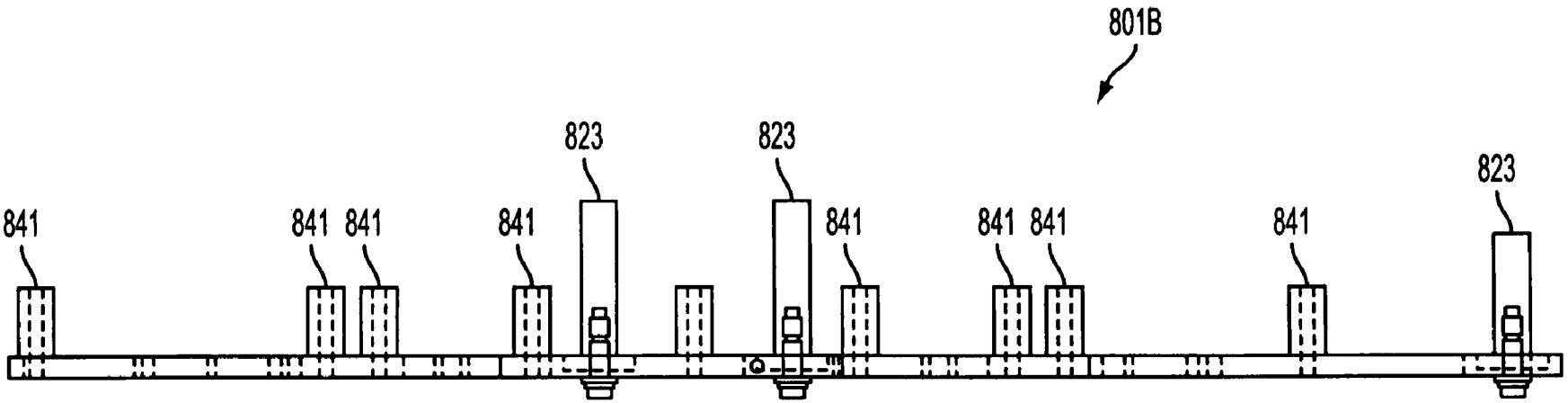
FIG. 12 provides various views of an embodiment of a plate and blanket bore aligning fixture for the operator side of the press.
Figure 13:
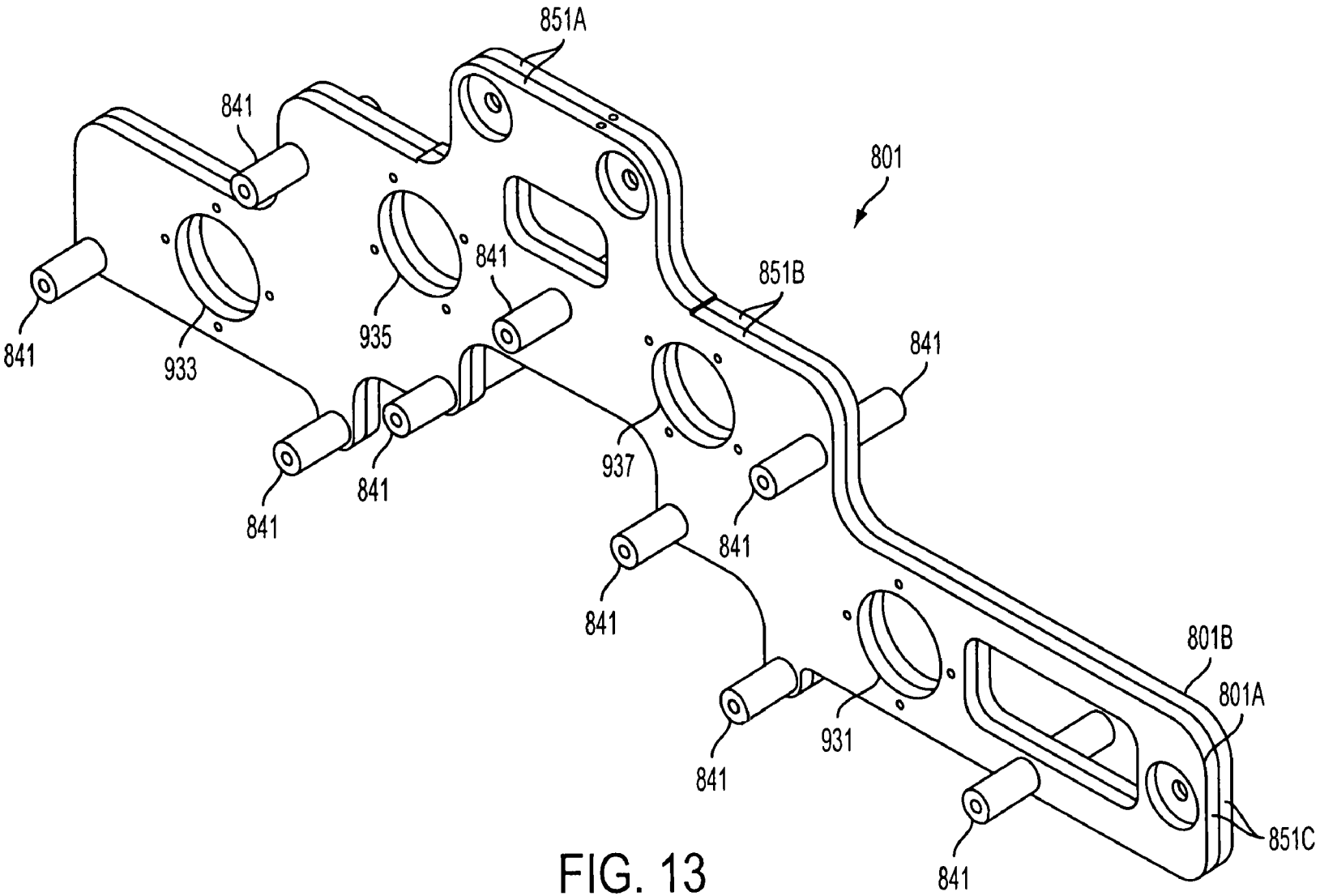
Figure 14:
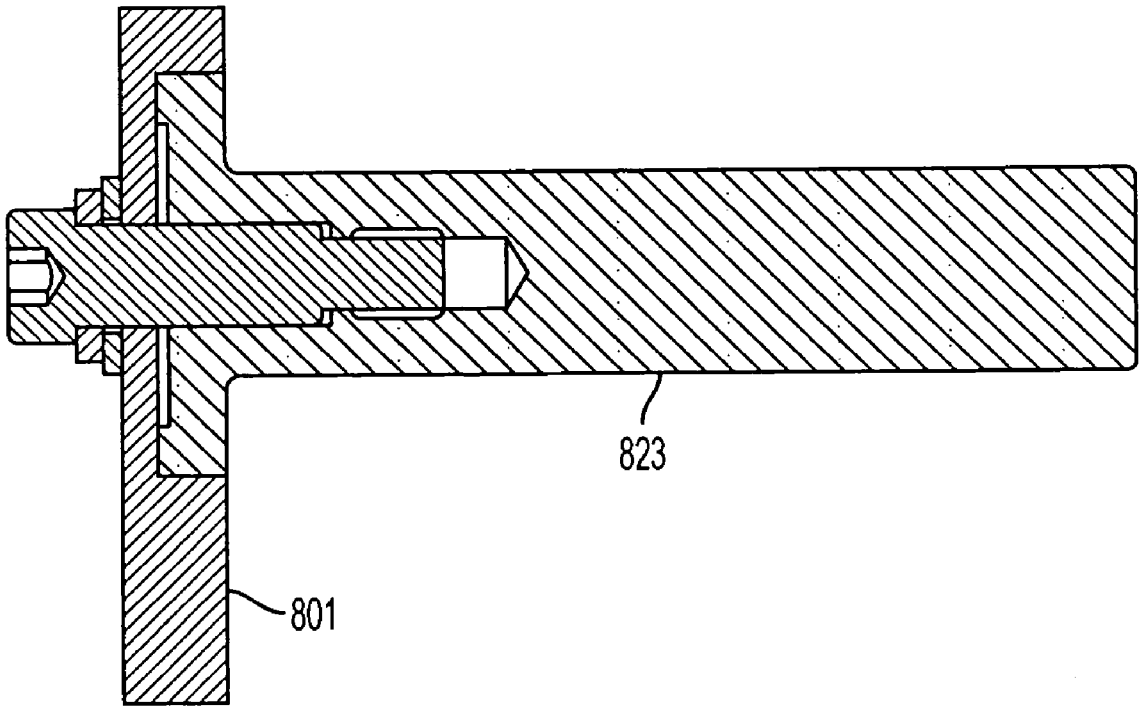
FIG. 14 provides a cross sectional view of an embodiment of an alignment pin of a plate and blanket bore aligning fixture.

Each of the plate and blanket fixtures (801A) and (801B) in the fixture set (801) generally comprises two plate and two blanket alignment holes which are designed to support a boring bar at the axis relating to the boring location of all the new bore holes. The two fixtures are essentially mirror images as shown by comparing FIG. 11 to FIG. 12, and as shown in FIG. 13 where they are shown placed back-to-back.

Each of the plate and blanket fixtures (801) also includes a series of alignment pins (823) and alignment surfaces (851) of generally similar design to those on the drill fixture (901). A cut through of a pin (823) is shown in FIG. 14B. The plate and blanket fixture (801) will therefore generally be aligned relative to the corner in much the same way as the drill fixture (901). In addition, the plate and blanket fixture (801) will include support mountings (841) generally at the same place as the support hole guides (941) were at on the drill fixture (901), therefore, when the plate and blanket fixture (801) is correctly aligned with the corner, the support mountings (841) should overlap the support holes drilled in the press frame based on the positioning of the drill fixture (901). This allows the plate and blanket fixture (801) to be rigidly bolted to the press unit (401) at a plurality of locations.

In most instances of use, this alignment will be sufficient to insure that each of the plate and blanket fixtures (801) is correctly aligned and attached to the press unit. However, in some embodiments, the system does include a further double check system to improve accuracy, if such double check is desired. In particular, while the axis of either the plate or blanket cylinder bore holes may need to be shifted in the boring operation, the other of the axes may not need to be shifted in some operations. That is, one or more of the new plate or blanket bores may be arranged co-axially with an existing plate or blanket bore. Whether this is the case or not will depend on the type of press being modified and the cut-off length the press is being modified to. Generally, the blanket cylinders, which have a smaller distance to shift, will be the bore hole which do not need to change, but this is by no means required.

In the situation where at least one of the new bore holes is supposed to be coaxial with an old bore hole, a measurement device may be incorporated to determine if the axes align once the plate and blanket fixture (801) has been aligned using the alignment pins (823) and alignment surfaces (851). These types of measurement devices are well understood by those of ordinary skill in the art and may comprise any format. In a preferred embodiment, the measurement device is an ultrasonic measurement device. The device will generally be mounted on a bore shaft which is arranged to be coaxial with the axis of the appropriate bore hole. This is the arrangement it would generally be in when prepared to initiate boring operations. The bore shaft can then be linearly extended in the same manner that it would when boring into the press but without boring. As the bore shaft is extended, the measurement device can determine if the bore shaft is co-axial with the old bore hole as the bore shaft passes through the old bore hole. It also makes sure that the bore shaft is correctly positioned to bore at the same time.

If the two axes are aligned, the double check has completed successfully and the plate and blanket fixture (801) is determined to be correctly aligned. At that time, boring may commence. If the axes are not aligned, the type of misalignment may be examined to determine the best course of action. If multiple bore holes are tested and the misalignment is consistent, it may be determined that the plate and blanket fixture (801) should be slightly shifted relative to the press frame as the original bore holes may have been slightly off positioned when initially bored. In this way, the new bore holes are aligned with the old bore holes, with recognition of a slight error in the old bore hole placement. Alternatively, depending on the desired size and shape of the new bore holes, a prior error can be compensated for and the new bore holes can be aligned to eliminate the original error in placement.

If there is a difference in one bore hole but not another, or if the axis shows discrepancy (e.g. from a non-circular hole) it might be the case that the holes have altered since they were originally bored such as by becoming worn. In this case, the double check may serve as a recognition that the original bore holes have become inaccurately positioned over time through wear or shifting. In this case, the new holes may be arranged to "correct" the inconsistency. Alternatively, the inconsistency may have become systematic and slight alterations need to be made to insure alignment of other components.

Regardless of the type of problem detected by the double check operation, generally the final decision on appropriate placement will be left to a skilled user. This type of fixture set, however, provides that the user with the information related to the positioning of the holes and since both sides of the press unit can have fixtures placed simultaneously, it allows for the user to make decisions based on a thorough understanding of both potential issues with regards to the press unit's initial construction, as well as information with regards to potential changes to the press unit over time.

Figure 11A:
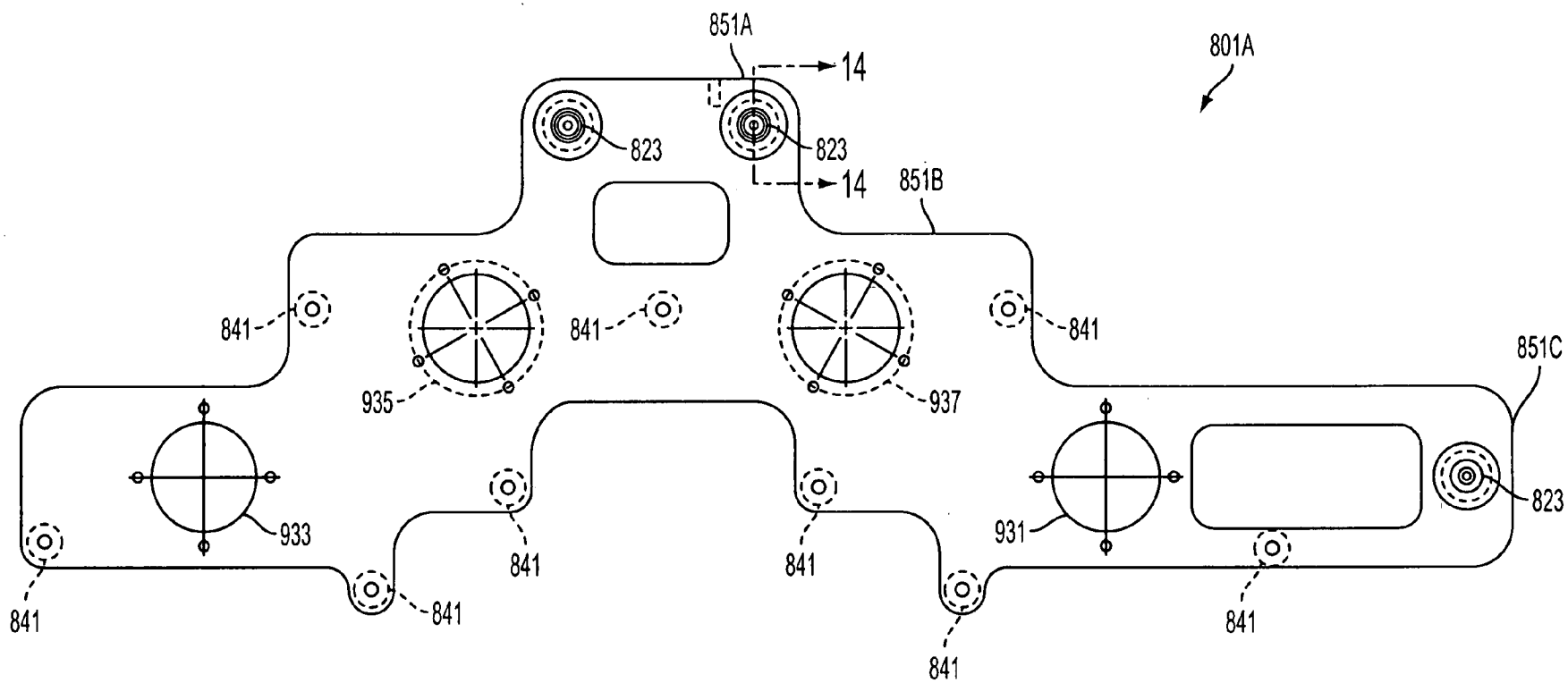
FIG. 11A provides for a front view while FIG. 11B provides for a top view.
Figure 11B:
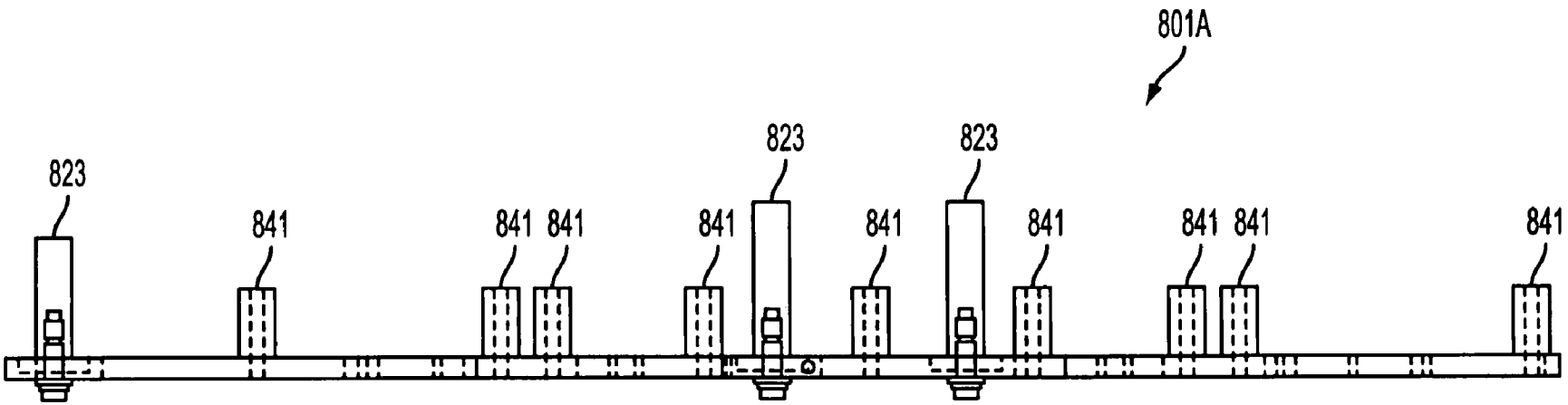
FIG. 11 provides various views of an embodiment of a plate and blanket bore aligning fixture for the drive side of the press.

Once the user is satisfied that both plate and blanket fixtures (801) in the set are correctly positioned on both the drive and operator side of the press unit and any discrepancies have either been corrected or deemed to be acceptable, a boring tool will be brought into position. Generally, the fixtures shown in FIGS. 11 and 12 are designed to be used by an operator being physically inside the frame of the press unit, or standing where the blanket and plate cylinders would be when the press unit is operational. The boring tool would therefore also be brought inside the frame (600) of the press unit. The boring tool is then aligned with one of the plate hole bore guides (931) or (933) generally by attachment through a bearing housing (985) attached to the bore guides, and the boring tool is used to bore into the frame (600) of the press unit to machine out the area dictated by the plate hole bore guide (931) or (933). The system may be arranged to drill corresponding holes on both the drive and operator side simultaneously in one embodiment, but that is by no means required.

After this process has been completed, the boring tool is generally moved to a blanket hole bore guide (935) or (937) and the new blanket bore holes are bored. It should be apparent that there is no need to bore the new plate bore holes before the new blanket holes and this order is purely exemplary, in other embodiments, alternative orders of boring may be used. Once all the holes have been bored into the press unit, the bolts are removed from the support mountings (841) separating the plate and blanket fixtures (801) from the frame of the press unit.

After this operation has been completed, the four new bores on each side of the press have all been machined and the press unit is ready for reassembly with the new plate and blanket rollers and other related components. The new bore holes (607) will generally be filled by new sleeves (designed to incorporate the relationships of mounting holes shown in FIG. 8) and the journals of the new blanket and plate cylinders can be placed in the mounting holes therein, aligned for operation.

Figure 17A:
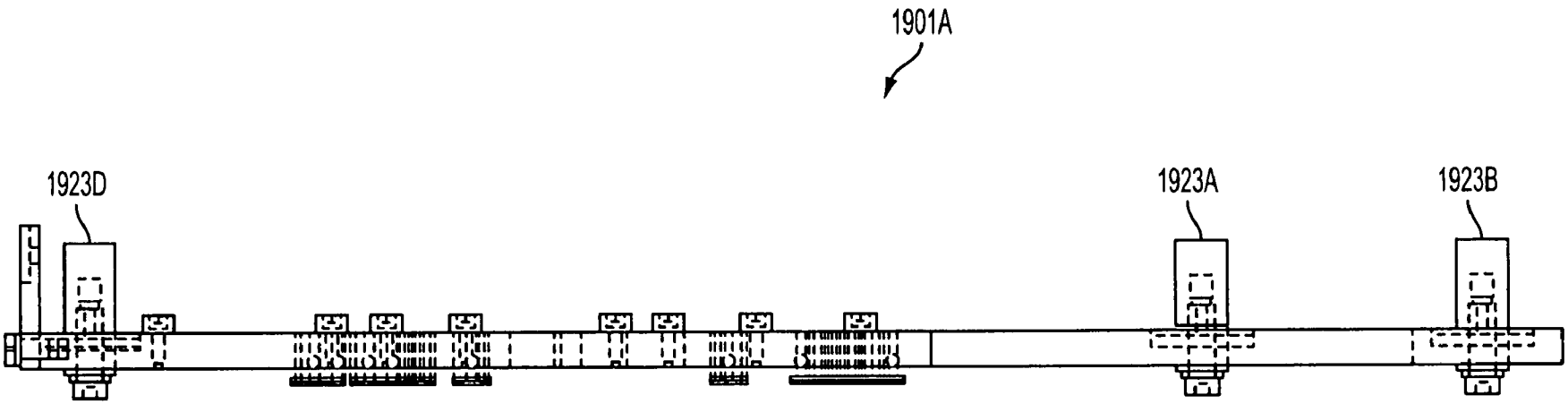
Figure 17B:
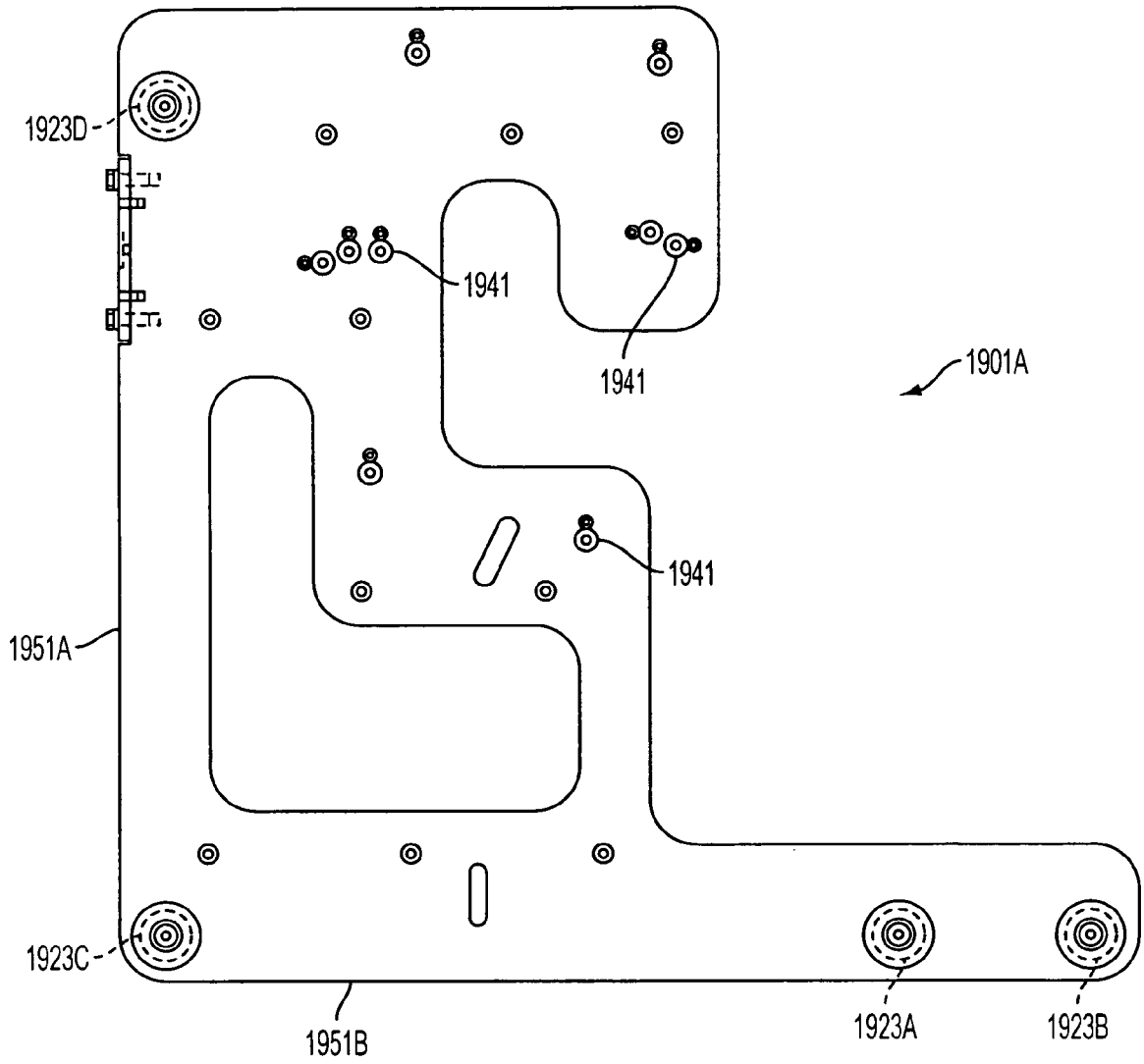
FIG. 17B shows a front view.
Figure 19A:
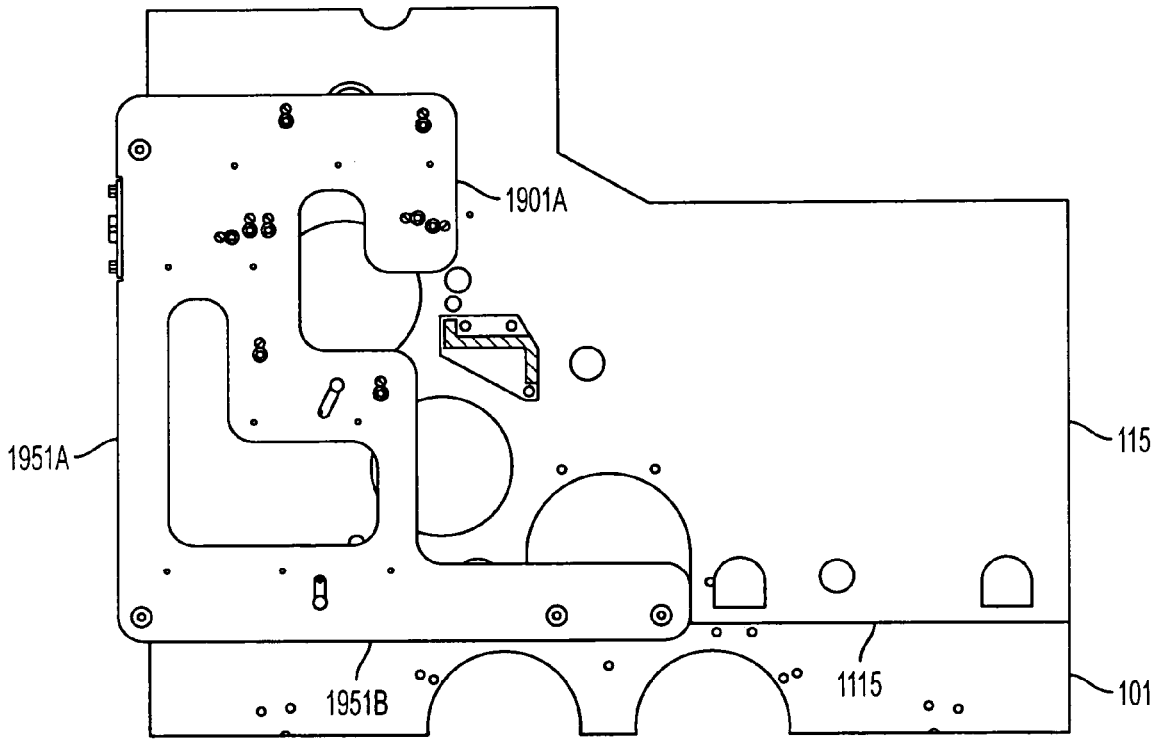
Figure 19B:
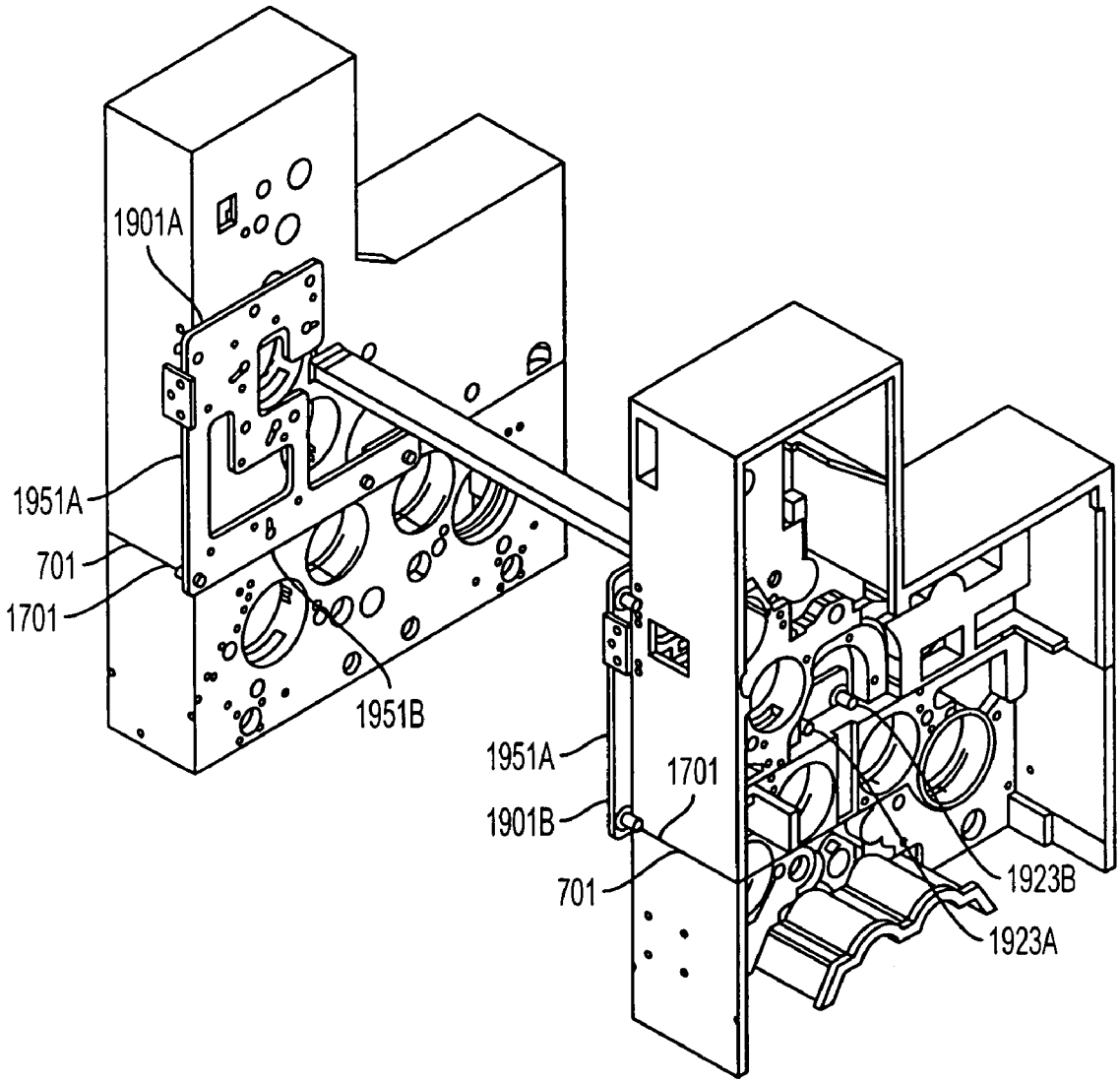
FIG. 19B shows a perspective view of both sides.

FIGS. 17 and 19 show embodiments of drill fixtures (1901) which can be used on a half deck unit (115). These drill fixtures (1901) will generally be used in the same way as drill fixture (901) are used in conjunction with the standard press unit (101) but are sized and shaped for use with the half-deck unit (115). As shown in FIG. 19, in most operational situations, the half-deck (115) will not be independent but will be seated on top of the press unit (101) forming a three-color unit (105). As discussed in conjunction with FIGS. 6–9 it is important that the common impression cylinder (48) line up with the blanket cylinders of both the standard press unit (101) and the half deck (115). Therefore it is best to have the half deck (115) in position on the standard press unit (101) to form the three-color unit (105) when performing the boring so that any discrepancies in its seating can be recognized.

In the depicted embodiment of FIGS. 17 and 19, the half deck (115) is a 13-side half-deck. The depicted half-deck modification using the fixtures (1801) and (1901) shown in FIGS. 17–20 has been selected to show a situation where the modifications will not require modification of the existing blanket cylinder bore hole, only of the existing plate cylinder bore hole. This exemplary embodiment therefore shows a situation where the new blanket cylinder fits in the existing blanket cylinder bore hole with a modified shoulder (501). This dramatically simplifies the necessary boring operation and allows for simpler designs of drill fixtures (1901) and also a plate hole boring fixture (1801) designed to only re-bore the plate hole. Further, this illustrates how the systems can be performed in an alternative embodiment where the holes for the blanket cylinders do not need to be rebored.

The drill fixtures (1901) are a set of fixtures (1901A) and (1901B) with one fixture for each side of the half-deck (115) unit. This is a variation from the drill fixture (901) where a single fixture was usable for both sides. Each of the drill fixtures (1901) includes a series of alignment pins (1923) as discussed in conjunction with the drill fixture (901) for the standard press unit (101). These may be of similar design to those shown in FIG. 14. In this design, however, the alignment pins (1923) are in a slightly altered arrangement. In particular, because the half deck (115) is in position on the press unit (101), the bottom edge (which is the edge generally used for alignment) of a half deck (115) is not readily accessible. The bottom edge (1115) is used for alignment because the bottom edge (1115) is in contact with the top edge of the standard press unit and dictates the relationship. In an embodiment, the half deck (1115) can be separated and turned upside down to provide for accessibility, but that is not preferred as it does not allow for possible variation in the connection between the two units and also requires the lifting and moving of an extremely heavy piece of machinery.

The only truly accessible points along the edge of intersection are the existing common impression cylinder bore hole which is open to the top surface of the press unit (101) in most designs. As the cylinders need to be aligned based on the relative location of the blanket cylinders in the standard press unit (101) so as to allow the common impression cylinder (48) to interact with the blanket cylinders of the standard press unit (101), the alignment pins (1923) for that bottom edge (1115) (as seen in FIG. 19A) are placed on the top surface of the standard press unit (101), instead of on the bottom edge (1115) of the half deck (115). Further, the two alignment pins (1923A) and (1923B) are placed in this opening. The third pin aligned with these two is aligned effectively with the corner (1701) of the half deck and is corner pin (1923C). The corner (1701) is the corner to which alignment is desired as it is in turn aligned with corner (701) by placement.

The corner pin (1923C) is not actually designed to align with the corner (1701) of the half-deck (115) but is aligned with both the two pins (1923A) and (1923B) to align with the top of the press unit (101), and with the side pin (1923D) for aligning with the side edge of the half-deck unit (115). As should be apparent, in the drill fixture (901) for the standard press unit, squareness with the corner was provided by having linearity on one side and then placing the other pin against the side to result in a square arrangement and gravity forced the pins (923) into the edges. The arrangement of the half deck (1115) is effectively performed by having linearity with both sides and a clear plane of pins on both sides using the corner pin (1923C) to prevent gravity from pulling the pins (1923) from the edges. In this way the corner pin (1923C) actually aligns vertically with the pin (1923D) on the side of the half deck (115). To align both sides of the drill fixture (1901) in such a way therefore aligns the drill fixture (1901) with the corner (1701) and effectively corner (701). In an alternative embodiment, the pin (1923C) may be eliminated for simplicity of design.

The drill fixture (1901) alignment may again be double checked using alignment surfaces (1951A) and (1951B) in the same way as this was performed for the press unit (101) and again adjustments may be performed as deemed necessary to align the drill fixture (1901). In the depicted embodiment, the side surface (1951A) is checked against the side of the half-deck frame while the bottom surface (1951D) is conformed to the top of the standard press unit. In an alternate embodiment, however, the bottom of the half-deck unit may be used.

Once the drill fixture is aligned, the process is similar to that discussed previously. The drill fixture (1901) is secured by placing bolts through ink roller alignment holes and securing the drill fixture (1901) to the half-deck unit (115). The support holes are then bored using support hole guides (1941), and the drill fixture (1901) is removed. After the drill fixtures (1901) are removed, the plate cylinder boring fixture (1801) will be placed. In the embodiment of FIG. 17, the two drilling fixture set (1901) provides that the fixture (1901) does not need to be used to drill the first side and then the second.

Figure 18A:
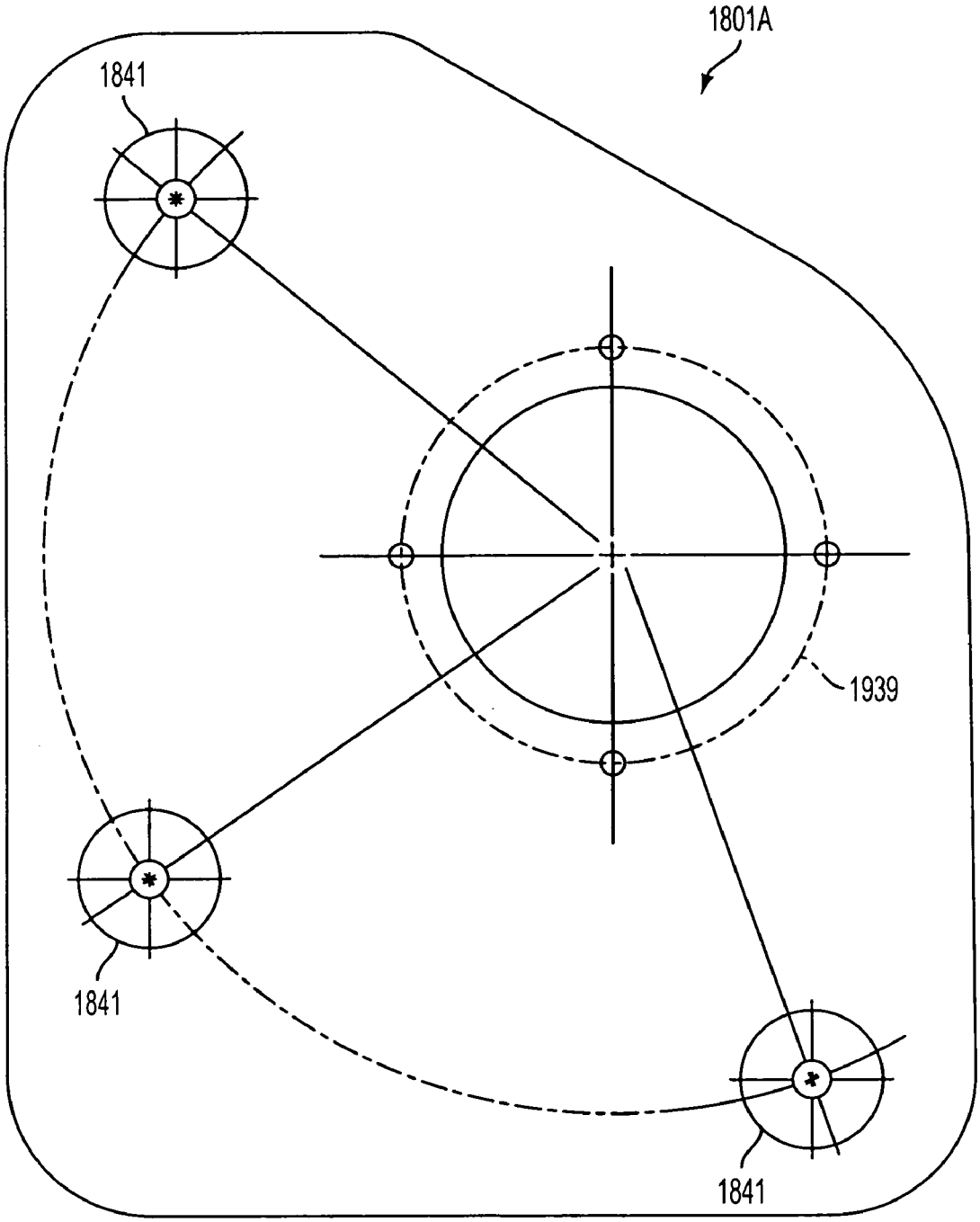
Figure 18B:
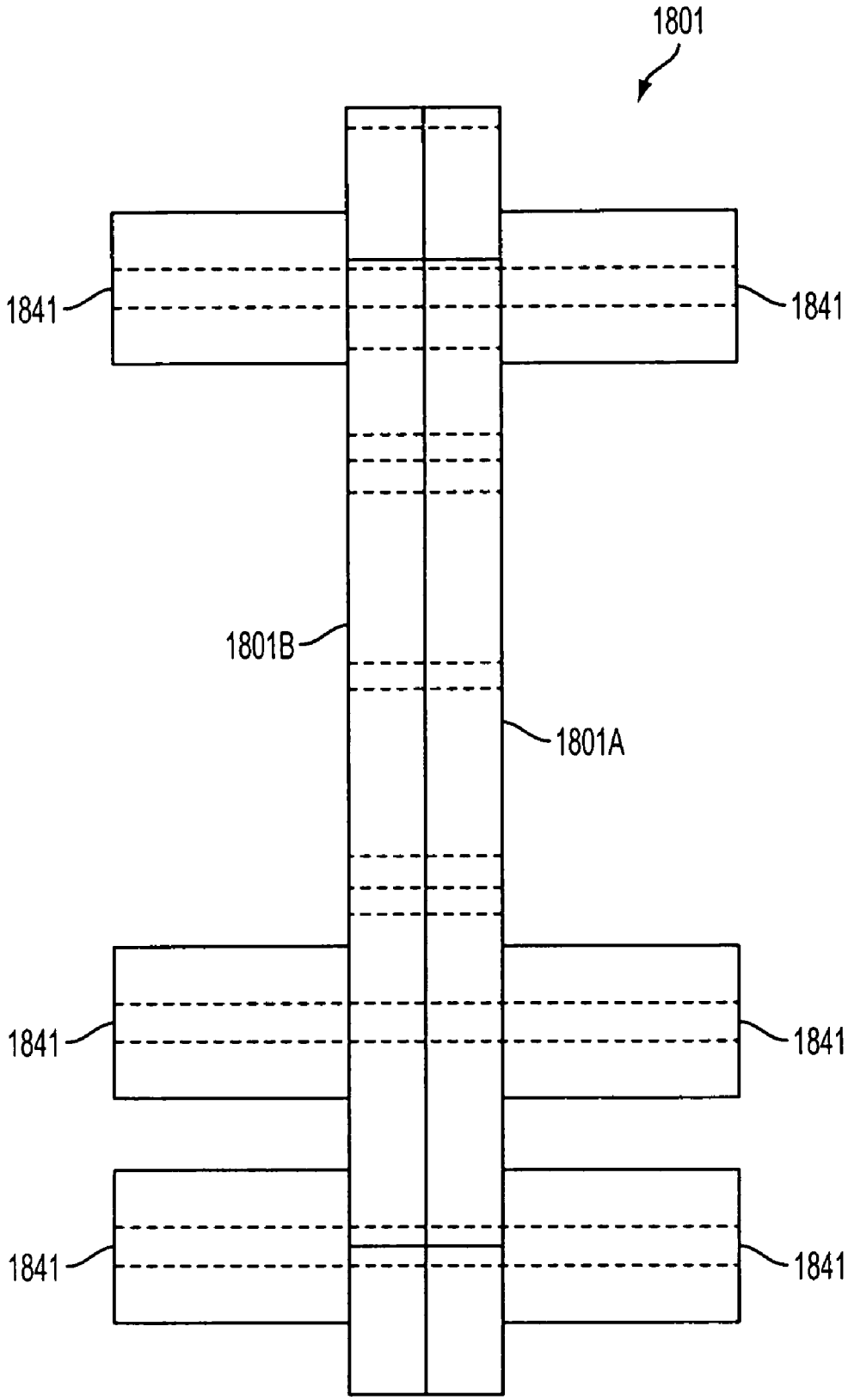
FIG. 18B is a top view.
Figure 20A:
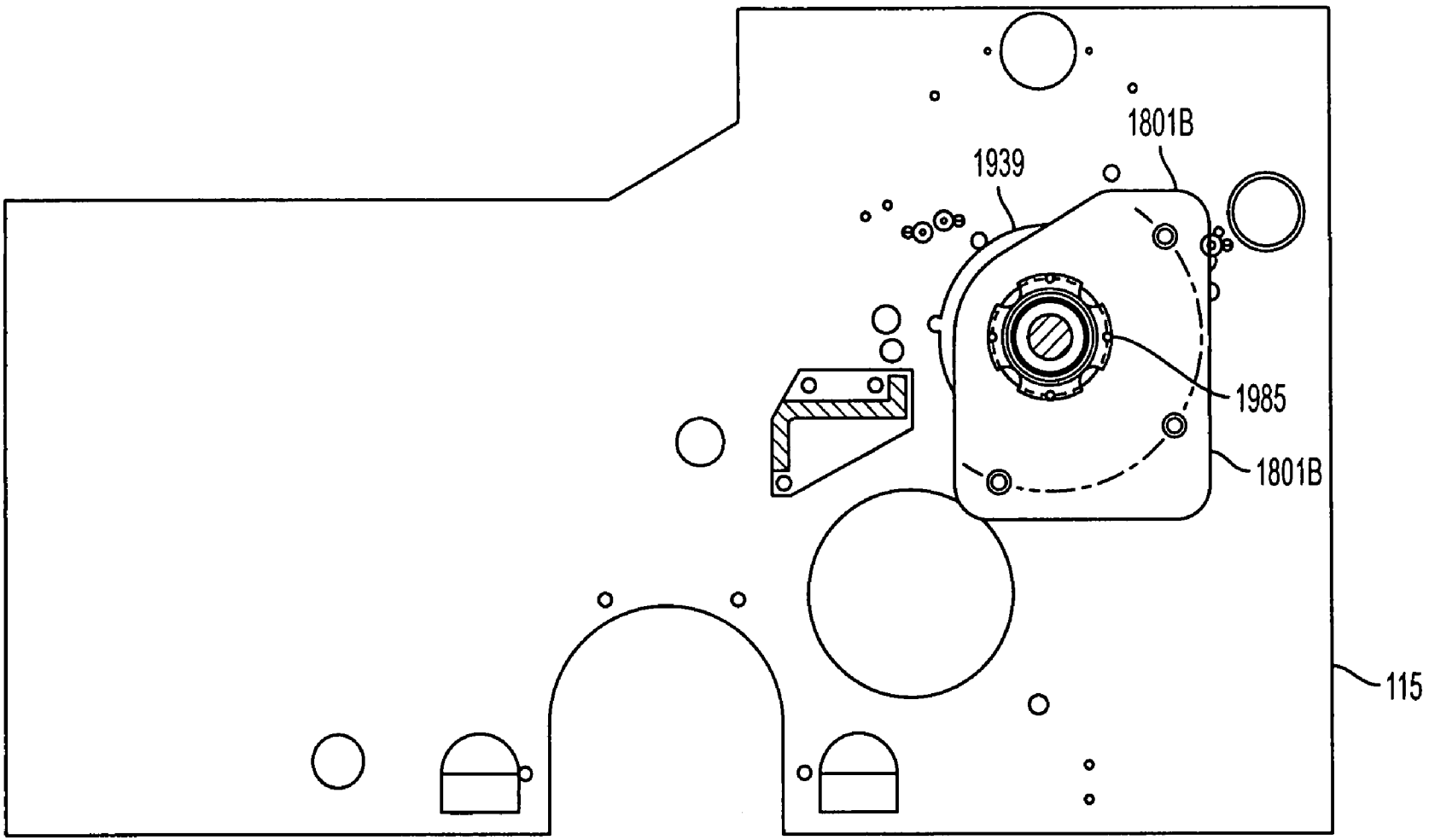
Figure 20B:
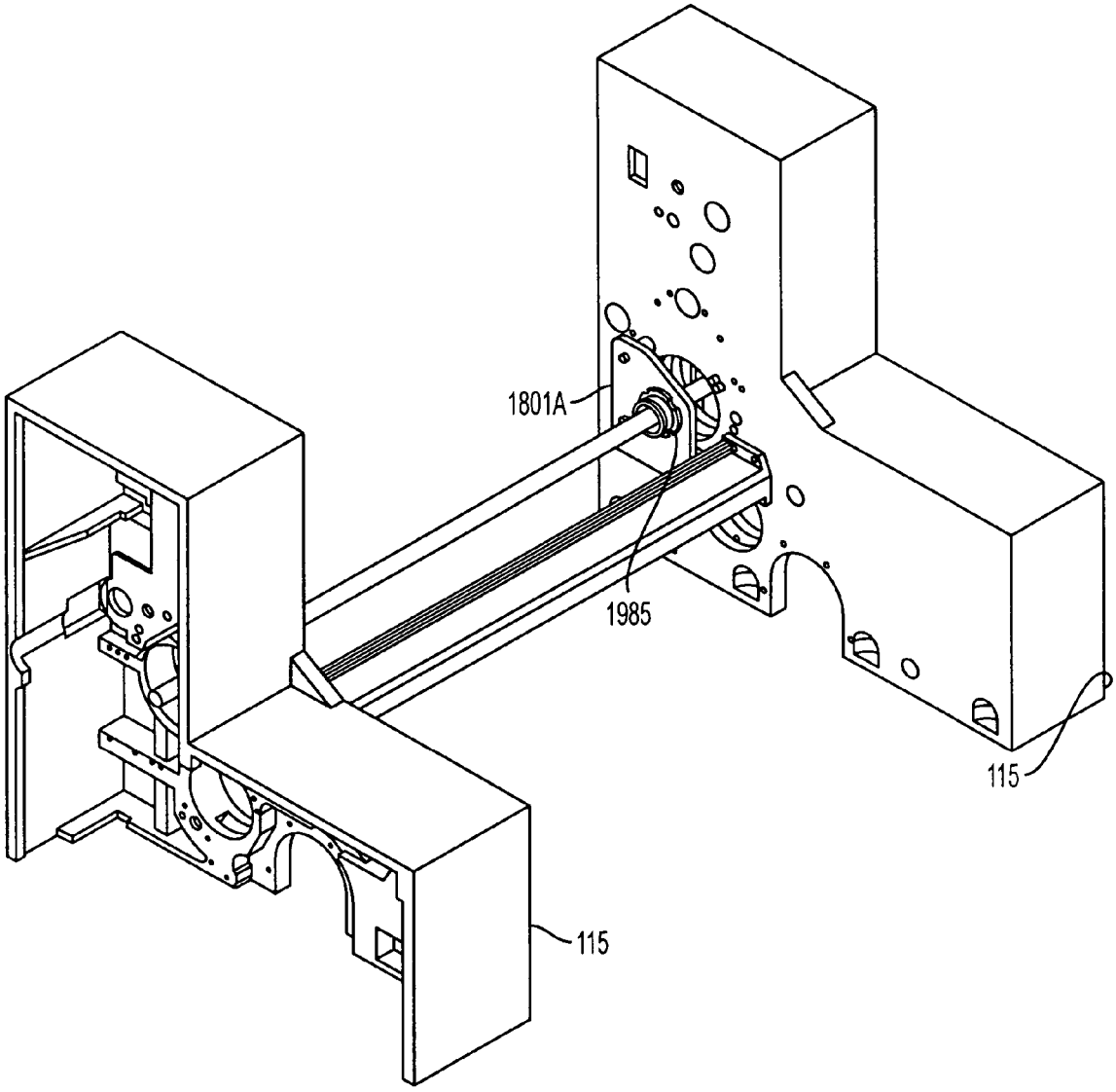
FIG. 20B shows a perspective of both sides.

FIGS. 18 and 20 provide for embodiments of the plate cylinder boring fixture (1801). As can be seen this fixture is very small as only the location of a single cylinder is to be bored on each side. The plate cylinder boring fixture (1801) again actually comprises a set of plate cylinder boring fixtures (1801A) and (1801B), one for each side of the half-deck unit. As should be apparent, the plate cylinder boring fixture (1801) does not include any alignment pins and may be aligned through the use of alignment surfaces (1851) and the connection to the support holes in a manner to the alignment previously discussed.

Alternatively, the plate hole boring fixture (1801) may be aligned by aligning the axis as discussed earlier. In another embodiment, the plate hole boring fixture (1801) is aligned by determining if the boring shaft, when placed, is parallel to any line between existing bore holes on the standard press unit. This is often preferred as it can be used to insure alignment with both structures on the half-deck and the standard press unit. Once the plate hole boring fixture (1801) is correctly aligned, it is solidly secured by again bolting through the support mountings (1841) into the support holes. The boring shaft is then attached using a mount (1985) which is positioned based on hole (1939) and the new plate cylinder hole may be bored in the same manner as for the standard press unit.

After all the various above bores have been machined in the various press units in the press line it may be necessary to alter other components of the press unit and/or press line so that the new print size is used correctly. For instance, this alternation will usually require new gearing to change the ratio to match the smaller diameter cylinders. The ink train would also probably require some new rollers and mounting brackets to allow the rollers to make contact with the new smaller plate cylinders. The common impression cylinder will also usually be replaced with a common impression cylinder of a larger diameter, and/or new bore holes may be drilled for that piece. The dampener mounting bracket may also have to be modified to match the smaller plate cylinders. Sidelay and circumferential assemblies may be designed to match the new bore hole design as they generally attach to the ends of the new cylinders.

All of these operations can be performed utilizing similar fixture constructions (if boring in the frame is required) which may also use some or all of the support holes previously drilled or may be standard engineering alterations (such as gear ratios) as would be known to those of ordinary skill in the art. Further, many of these operations can already have boring holes of some form arranged for the attachment of these parts as the support holes may be positioned so as to be used by these new or altered components. Alternatively, the support holes may be arranged to be at the axis of the new hole. This can simplify work to get the rest of the press unit arranged as there is a prealigned relationship from the support holes to the new bore holes based on the various fixtures conservation. In particular, since the support holes were drilled based on the alignment of the drill fixture, and the plate and blanket fixture used the support holes as part of its alignment procedure for the boring of the new plate and blanket holes, the arrangement of the support holes to the new plate and blanket holes is generally predetermined.

While it is only briefly discussed here, as the exact design is generally beyond the scope of this discussion, the folder unit (121) would also generally be modified to accommodate the new page size. There will generally be a cassette consisting of a folding and cutting cylinder of the new diameters (related to the diameter of the plate and blanket cylinders) that will allow for folding and cutting of the new cut-off length. Gearing throughout the folder (121) would then be designed to match the new folding and cutting cylinders. Finally, angle bars (111) and idle rollers throughout the system may be adjusted to provide for the ability to correctly register the pages from all the printing units of the press line which all have been modified for the new cut-off length.

As should be apparent from the figures, the systems and methods discussed herein generally allow for the modification of an existing printing press to accommodate a smaller cut-off. This operation is generally designed to be performed in a straightforward repeatable fashion on multiple press units through the use of fixtures which provide for the correct alignment of new bores based on the corner of the press and allowing for the double-checking of position based on old and new bore hole axis positioning. As corner alignment relates to the way bore holes are originally drilled, it provides for a methodology that can detect errors in original bore hole placement (both from initial boring errors and from wear) and can either adapt to take those errors into account, or eliminate the errors through reboring. Further, the systems and methods allow for the modification of the press units on site and in the press line, so long as the press line can be shut down during the period of modification and it is not necessary to remove the press unit from the press line which can entail significant extra expense. This can allow for more economical modification as it is not necessary to remove the heavy presses and then return them once they have been modified.

While the above discussion discloses a preferred embodiment of the invention which utilizes only the existing frame of the press unit as the support for the new bore holes which are cut directly into the existing frame, this is not the only embodiment of the invention. In an alternative embodiment, the holes may be bored through a new frame component for the press, before the modification takes place. For instance, the holes may be machined in a piece of cast iron prior to the press being taken off line. This piece of cast iron may then be brought to the press on site, and welded, bolted, clamped or otherwise rigidly attached on the inside of each of the sides of the frame of the press unit. Then cylinders of a shorter length and the decreased diameter could be mounted on sleeves through the new bores as discussed previously without having to modify extensively the existing frame structure. While this can be a time-saving embodiment in some situations, this embodiment has the disadvantage that the new plate and blanket cylinders are necessarily shorter than the existing cylinders. If the press operation used the full width of the old cylinder in printing the pages, this length reduction may be undesirable.

In still another embodiment, the existing bore holes may be filled (or partially filled) with a rigid material (such as a resin, plastic, or metal) once the cylinders have been removed, and completely new bore holes be machined therethrough. This can allow for an incomplete overlap of the new and old bore holes (allowing the new bore holes to have the same or a decreased diameter when compared to the old) without losing functionality, but will generally be a more time consuming operation and will often result in the frame of the press unit having a weaker structure than in the depicted embodiment.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A method for converting a newspaper press unit to produce a different cut-off length, the method comprising:

providing a press unit located as part of a press line, said press unit having a press unit frame supporting existing blanket cylinders and existing plate cylinders in existing blanket bore holes and existing plate bore holes respectively;

removing said existing blanket cylinders and said existing plate cylinders from said existing blanket bore holes and said existing plate bore holes;

aligning a drill fixture to said frame, said drill fixture including an alignment pin arranged in proximity to at least one of a side and the top of said press unit;

attaching said drill fixture to said frame;

boring, based on said drill fixture, a plurality of support holes removing said drill fixture;

aligning a plate and blanket fixture, said plate and blanket fixture including an alignment pin arranged in proximity to at least one of said side and said top of said press unit to which said alignment pin of said drill fixture was placed in proximity to;

attaching said plate and blanket fixture to said frame via said support holes;

boring, based on said plate and blanket fixture, new blanket bore holes and new plate bore holes, said new blanket bore holes and said new plate bore holes having a diameter greater than said existing blanket bore holes and said existing plate bore holes respectively and encompassing said existing blanket bore holes and said existing plate bore holes respectively;

removing said plate and blanket fixture;

placing new plate cylinders and new blanket cylinders having a new diameter in said new plate bore holes and said new blanket bore holes respectively; and using said new plate cylinders and said new blanket cylinders to print a newspaper having a different cut-off length.

2. The method of claim 1 wherein at least one of said new blanket cylinders is mounted by placing journals of said blanket cylinder in a mounting hole in a sleeve, and placing said sleeve in said new blanket bore hole.

3. The method of claim 1 wherein said cut-off length is changed to 21 inches.

4. The method of claim 1 wherein said cut-off length is changed to a value less than 21 inches.

5. The method of claim 1 wherein said cut-off length is reduced from a cut-off length of 21 and ½ inches.

6. The method of claim 1 wherein said cut-off length is reduced from a cut-off length of 22 inches.

7. The method of claim 1 wherein said cut-off length is reduced from a cut-off length of 22 and ¾ inches.

8. The method of claim 1 wherein said cut-off length is reduced from a cut-off length of 23 and 9/16 inches.

9. The method of claim 1 wherein said plate and blanket fixture is one of a set of two plate and blanket fixtures, one of said set of two plate and blanket aligning fixtures attaching to an operator side of said press unit and the other of said set of two plate and blanket aligning fixtures attaching to the drive side of said press unit.

10. The method of claim 1 wherein said drill fixture includes at least three alignment pins.

11. The method of claim 10 wherein at least two of said alignment pins on said drill fixture are arranged in proximity to said top of said press unit, and at least one of said alignment pins on said drill fixture is arranged in proximity to said side of said press unit.

12. The method of claim 11 wherein said plate and blanket fixture includes at least three alignment pins.

13. The method of claim 12 wherein at least two of said alignment pins on said plate and blanket fixture are arranged in proximity to said top of said press unit, and at least one of said alignment pins on said plate and blanket fixture is arranged in proximity to said side of said press unit.

14. A method for machining new bore holes for mounting blanket and plate cylinders in a printing press, the method comprising:

providing a newspaper press located as part of a press line;

removing from said press old blanket cylinders and old plate cylinders from old blanket bore holes and old plate bore holes respectively;

attaching a first fixture, said first fixture being aligned with a side and a top of said press unit;

boring, based on said first fixture, a plurality of support holes;

removing said first fixture;

attaching a second fixture, aligned with said side and said top of said press unit to which said first fixture was aligned to said press unit using said support holes;

boring, based on said second fixture, new bore holes;

removing said second fixture; and placing new plate cylinders and new blanket cylinders having a new diameter in said new bore holes.

15. The method of claim 14 further comprising the step of placing components which form part of the ink train of said press, when used with said new plate cylinder and said new blanket cylinders, in at least some of said support holes.

16. A set of fixtures for use in machining new bore holes for mounting blanket and plate cylinders in a printing press unit, the set of fixtures comprising:

a drill fixture, said drill fixture including:

a frame comprised of a rigid material;

at least three alignment pins arranged on said fixture in a manner such that they can be placed adjacent to a top and a side of said printing press unit; and a plurality of support alignment guides machined through said frame;

wherein, when said three alignment pins are arranged adjacent said top and said side of said printing press unit, said support alignment guides indicates a position to machine new support holes in said printing press unit; and a plate and blanket fixture, said plate and blanket fixture including:

a frame comprised of a rigid material;

at least three alignment pins arranged on said fixture in a manner such that they can be placed adjacent to a top and a side of said printing press unit;

a plurality of support mountings machined through said frame; and two blanket hole guides and two plate hole guides machined through said frame;

wherein, when said at least three alignment pins are arranged adjacent said top and said side of said printing press unit, said support mountings align with said new support holes in said printing press unit; and wherein said blanket hole guides and said plate hole guides can be used to bore new blanket holes and new plate holes respectively in said press unit.

17. The set of fixtures of claim 16 wherein said set of fixtures comprises a single drill fixture and two plate and blanket fixtures.

18. The set of fixtures of claim 16 wherein said drill fixture includes an additional three alignment pins arranged to extend from said frame in a direction opposite said three alignment pins.

19. A method for converting a newspaper press half deck to produce a different cut-off length, the method comprising:

providing a three-color unit comprising a half deck located on a standard unit and having a half deck frame supporting an existing blanket cylinder, an existing plate cylinder, and an existing common impression cylinder in an existing blanket bore hole, an existing plate bore hole, and an existing common impression cylinder bore hole respectively;

removing said existing blanket cylinder, said plate cylinder, and said common impression cylinder from said existing blanket bore hole, and said existing plate bore hole and said existing general impression bore hole;

aligning a drill fixture to said frame, said drill fixture including an alignment pin arranged in proximity to the top of said standard press unit and within said existing common impression cylinder bore hole;

attaching said drill fixture to said frame;

boring, based on said drill fixture, a plurality of support holes;

removing said drill fixture;

attaching a plate cylinder boring fixture to said frame via said support holes;

boring, based on said plate cylinder boring fixture, a new plate bore hole, said new plate bore hole having a diameter greater than said existing plate bore hole and encompassing said existing plate bore hole;

removing said plate cylinder boring fixture;

placing new plate cylinders and new blanket cylinders having a new diameter in said new plate bore holes and said existing blanket bore holes respectively; and using said new plate cylinders and said new blanket cylinders to print a newspaper having a different cut-off length.

* * * * *